US011225089B2

(12) United States Patent
Harada et al.

(10) Patent No.: US 11,225,089 B2
(45) Date of Patent: Jan. 18, 2022

(54) MEDIUM DRYING DEVICE, MEDIUM PROCESSING APPARATUS, AND RECORDING SYSTEM

(71) Applicant: SEIKO EPSON CORPORATION, Tokyo (JP)

(72) Inventors: Yutaro Harada, Shiojiri (JP); Kohei Ueno, Matsumoto (JP); Nobuyuki Mizushima, Shiojiri (JP); Shunpei Yamaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/719,069

(22) Filed: Dec. 18, 2019

(65) Prior Publication Data

US 2020/0198369 A1 Jun. 25, 2020

(30) Foreign Application Priority Data

Dec. 21, 2018 (JP) ..... JP2018-240170

(51) Int. Cl.
*B41J 11/00* (2006.01)
*B41J 3/24* (2006.01)

(52) U.S. Cl.
CPC ..... *B41J 11/002* (2013.01); *B41J 3/24* (2013.01)

(58) Field of Classification Search
CPC ..... B41J 11/002; B41J 3/24; B65H 37/04; B42C 1/12
See application file for complete search history.

(56) References Cited

U.S. PATENT DOCUMENTS

2012/0249704 A1 10/2012 Kato et al.
2018/0015737 A1* 1/2018 Harada ..... B41J 3/60

FOREIGN PATENT DOCUMENTS

JP 2601376 B2 * 4/1997
JP 2012210758 11/2012

* cited by examiner

*Primary Examiner* — Sharon Polk
(74) *Attorney, Agent, or Firm* — Workman Nydegger

(57) ABSTRACT

A medium drying device includes a heat roller pair that dries a medium recorded and transported by a line head, and a perforation portion that forms a plurality of holes on an area including a recorded area of the medium. The perforation portion includes a plurality of piercing portions configured to pierce the medium, and the piercing portions are provided on an outer peripheral surface of a drying driving roller of the heat roller pair.

15 Claims, 15 Drawing Sheets

MEDIUM DRYING DEVICE, MEDIUM PROCESSING APPARATUS, AND RECORDING SYSTEM

The present application is based on, and claims priority from JP Application Serial Number 2018-240170, filed Dec. 21, 2018, the disclosure of which is hereby incorporated by reference herein in its entirety.

BACKGROUND

1. Technical Field

The present disclosure relates to a medium drying device that dries a medium, a medium processing apparatus including the medium drying device, and a recording system including the medium drying device.

2. Related Art

In a medium processing apparatus that performs processing, such as stapling processing and punching processing, on a medium, for example, transported mediums are sent to a loading tray and ends of the mediums are aligned with each other in the loading tray. Thereafter, the processing such as the stapling processing and the punching processing is performed. Further, such a medium processing apparatus may be provided adjacent to a recording apparatus represented by a printer and may constitute a recording system as a whole.

In the above-described recording system, when the recording apparatus is an ink jet printer that performs recording by ejecting ink to a medium, an unique problem occurs. That is, in the medium on which the recording is performed by ejecting the ink, since friction of an ink ejection surface becomes high, there is a problem in that when the medium processing apparatus performs the processing, the integrity of the medium in the loading tray deteriorates. Then, in order to cope with the problem, a drying device that dries the medium before the medium is sent to the loading tray may be provided.

A drying device including a drying roller pair that heats a medium while sandwiching the medium is disclosed in JP-A-2012-210758.

In the drying device, when the medium is dried by applying heat to the medium from the outside, a liquid component near the surface of the medium is evaporated. However, the liquid component remains near the center of the medium in a thickness direction, and the medium may not be sufficiently dried.

The drying device may not only perform drying by heat, but also perform drying by blowing air to the medium. Similarly, in this case, only a liquid component near the surface of the medium is evaporated, and thus the liquid component remains near the center of the medium in the thickness direction.

SUMMARY

A medium drying device for solving the above-described problems includes a drying processing unit that dries a medium recorded and transported by a recording section, and a perforation portion that forms a plurality of holes in an area including a recorded area of the medium.

DESCRIPTION OF EXEMPLARY EMBODIMENTS

Figure 1:
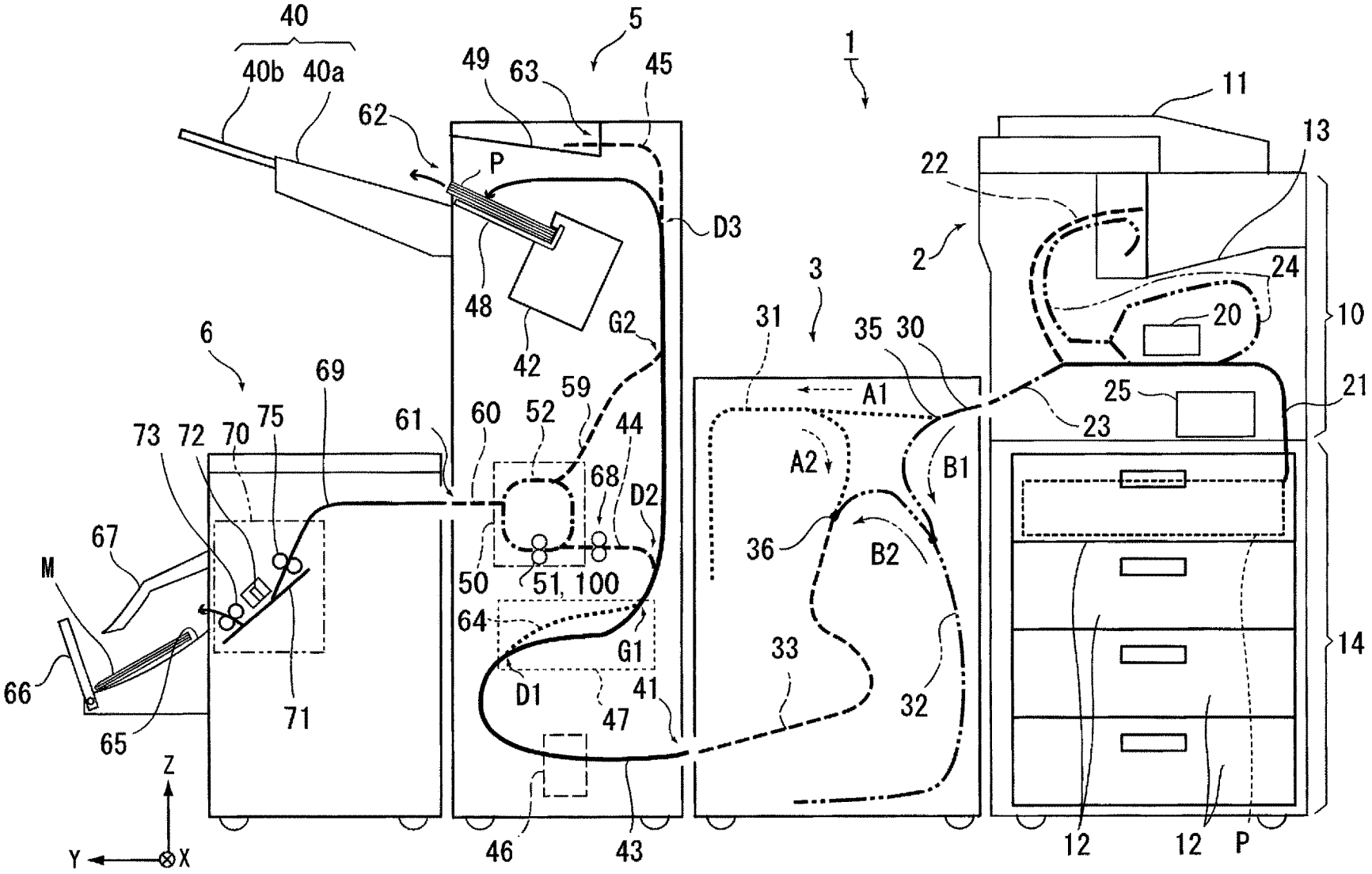
FIG. 1 is a schematic view of a recording system.

Hereinafter, the present disclosure will be schematically described.

According to an aspect of the present disclosure, a medium drying device according to a first aspect includes a drying processing unit that dries a medium recorded by a recording section and transported, and a perforation portion that forms a plurality of holes in an area including a recorded area of the medium.

When a plurality of holes are formed in the medium, liquid is easily evaporated from the inside of the medium in the thickness direction. According to this aspect, since the medium drying device includes the drying-processing unit that dries the transported medium and the perforation portion that forms the plurality of holes in the medium, the medium can be effectively dried by the drying processing unit.

In the device, a second aspect of the present disclosure provides the medium drying device according to the first aspect, in which the drying processing unit includes a drying roller pair that holds the medium between a drying driving roller that is rotationally driven and a drying driven roller that is driven to rotate by the rotation of the drying driving roller and transports the medium, and one or both of the drying driving roller and the drying driven roller are heated.

According to this aspect, since the drying processing unit includes a drying roller pair in which one or both of the drying driving roller and the drying driven roller are heated, the medium can be heated while the medium is nipped and transported by the drying roller pair.

In the device, a third aspect of the present disclosure provides the medium drying device according to the first aspect or the second aspect, in which the perforation portion is disposed upstream of the drying processing unit in a medium transport direction.

According to this aspect, since a plurality of holes are formed in the medium before drying by the drying processing unit, the medium can be effectively dried by the drying processing unit.

In the device, a fourth aspect of the present disclosure provides the medium drying device according to any one of the first aspect to the third aspect, which further includes a transport roller pair that holds the medium between a transport driving roller that is rotationally driven and a transport driven roller that is driven to rotate by the rotation of the transport driving roller, in which the perforation portion includes a plurality of piercing portions that are configured to pierce the medium, and the piercing portions are provided on an outer peripheral surface of one of the transport driving roller and the transport driven roller.

According to this aspect, when the medium is transported by the transport roller pair that holds the medium between the transport driving roller and the transport driven roller, the piercing portions pierce the medium to form a plurality of holes in the medium.

In the device, a fifth aspect of the present disclosure provides the medium drying device according to the second aspect, in which the perforation portion includes a plurality of piercing portions that are configured to pierce the medium, and the piercing portions are provided on an outer peripheral surface of one of the drying driving roller and the drying driven roller.

According to this aspect, when the medium is transported by the drying roller pair, which is a drying processing unit, the piercing portions can pierce the medium to form a plurality of holes in the medium.

Since the plurality of holes are formed in the medium while the medium is heated by the drying roller pair as the drying processing unit, the medium can be effectively dried. Further, since the drying roller pair can have the function of the perforation portion, the device can be miniaturized.

In the device, a sixth aspect of the present disclosure provides the medium drying device according to the fifth aspect, in which the roller, on which the piercing portions are provided, is heated.

According to this aspect, since the roller, on which the piercing portions are provided, is heated, the medium can be more effectively dried.

In the device, a seventh aspect of the present disclosure provides the medium drying device according to any one of the fourth aspect to the sixth aspect, in which the roller, on which the piercing portions are provided, is configured to be displaced between an advanced position where the piercing portions pierce the medium and a retracted position where the piercing portions do not pierce the medium.

According to this aspect, it is possible to switch between a state in which the piercing portions pierce the medium to form the plurality of holes in the medium and a state in which the piercing portions do not pierce the medium so as not to form the plurality of holes in the medium.

In the device, an eighth aspect of the present disclosure provides the medium drying device according to any one of the first aspect to the seventh aspect, which further includes a loop-like transport path that includes the drying processing unit and is configured to circumferentially transport the medium.

According to this aspect, since the medium drying device includes the loop-like transport path including the drying processing unit and configured to circumferentially transport the medium, by circumferentially transporting the medium, the drying processing by the drying processing unit can be performed a plurality of times, and more reliable drying can be performed. Further, it is possible to suppress an increase in the size of the device without increasing the size of the transport path for performing the drying processing a plurality of times.

In the device, a ninth aspect of the present disclosure provides the medium drying device according to the eighth aspect, when the medium is transported through the loop-like transport path, the perforation portion perforates a hole from a surface facing an outside of a loop.

According to this aspect, since a hole is opened in the medium from the surface facing an outside of a loop of the loop-like transport path, the medium can be bent to open the hole when passing through the loop-like transport path, and a liquid component can be easily evaporated.

According to another aspect of the present disclosure, a medium processing apparatus according to a tenth aspect includes a reception unit that receives a medium to be processed, the medium drying device according to the first aspect to the ninth aspect, which performs drying processing on the medium received from the reception unit, and a processing unit that performs processing on the medium received from the reception unit or the medium drying-processed by the medium drying device.

According to this aspect, in the medium processing apparatus including the reception unit that receives the medium to be processed, the medium drying device that performs the drying processing on the medium received from the reception unit, and the processing unit that performs the processing on the medium received from the reception unit or the medium drying-processed by the medium drying device, the same function and effect as any one of the first aspect to the ninth aspect can be obtained.

In the apparatus, an eleventh aspect of the present disclosure provides the medium processing apparatus according to the tenth aspect, which further includes a saddle stitching processing unit that stitches a central portion of the medium drying-processed by the medium drying device in a medium transport direction.

According to this aspect, in addition to the processing by the processing unit, saddle stitching processing can be performed on the medium drying-processed by the medium drying device.

In the apparatus, a twelfth aspect of the present disclosure provides the medium processing apparatus according to the tenth aspect, which further includes a first discharge section that discharges the medium drying-processed by the medium drying device, to an outside of an apparatus body, a second discharge section that discharges the medium processed by the processing unit, to the outside of the apparatus body, and a tray that receives the medium from the second discharge section, in which a saddle stitching unit, which is provided outside the apparatus main body, receives the medium discharged from the first discharge section, and performs saddle stitching processing of stitching a central portion in a medium discharge direction, is configured to be attached to and detached from a lower side of the tray.

According to this aspect, in addition to the processing by the processing unit, since the saddle stitching unit is configured to be detachable from the lower side of the tray, it is possible to easily switch between a configuration having the saddle stitching unit and a configuration not having the saddle stitching unit.

Further, when the saddle stitching unit is mounted, the saddle stitching unit is located below the tray. Thus, removal of the medium discharged to the tray cannot be hindered by the saddle stitching unit.

According to yet another aspect of the present disclosure, a recording system according to a thirteenth aspect includes a recording unit that includes a recording section, and the medium processing apparatus according to any one of the tenth aspect to the twelfth aspect, which processes the medium after the recording by the recording section.

According to this aspect, in the recording system, the operational effects of any one of the tenth aspect to the twelfth aspect described above can be obtained.

First Embodiment

Hereinafter, a first embodiment will be described with reference to the drawings. In an XYZ coordinate system shown in each drawing, an X axis direction indicates the depth direction of an apparatus, a Y axis direction indicates the width direction of the apparatus, and a Z axis direction indicates the height direction of the apparatus.

Outline of Recording System

A recording system 1 illustrated in FIG. 1 includes, as an example, a recording unit 2, an intermediate unit 3, a first unit 5 as the medium processing apparatus, and a second unit 6 as a saddle stitching unit that is detachably attached to the first unit 5, in an order from the right side to the left side of FIG. 1.

The first unit 5 is provided with a medium drying device 50 that performs drying processing on a received medium and an end stitching unit 42 that performs end stitching processing of bundling media on which recording has been performed by the recording unit 2 and stitching ends of the media. The end stitching unit 42 is an example of a processing unit that performs processing on the medium received by the first unit 5. The second unit 6 is provided with a saddle stitching processing unit 70 that performs saddle stitching processing of stitching and folding a center of a bundle of the media on which recording has been performed by the recording unit 2 to make a booklet.

The recording system 1 can be configured so as not to perform the saddle stitching processing as post-processing that is performed on the media which have been recorded by the recording unit 2 after the second unit 6 is removed. Further, illustration of the recording system 1 from which the second unit 6 is removed will be omitted.

The recording unit 2 performs recording on a transported medium. The intermediate unit 3 receives the medium, on which recording has been performed, from the recording unit 2 to send the medium to the first unit 5. The first unit 5 performs processing, such as the drying processing and the end stitching processing, on the received medium. The first unit 5 can transmit the medium after the drying processing to the second unit 6. The second unit 6 performs the saddle stitching processing.

Hereinafter, the recording unit 2, the intermediate unit 3, the first unit 5 (the medium processing apparatus), the medium drying device 50, and the second unit 6 will be described in detail in order.

In Recording Unit

The recording unit 2 will be described with reference to FIG. 1. The recording unit 2 is configured as a multifunction device including a printer unit 10 having a line head 20 as a recording section for performing recording on the medium and a scanner unit 11. In the present embodiment, the line head 20 is configured as a so-called ink jet recording head that performs recording by ejecting ink, which is liquid, onto the medium.

A cassette accommodating unit 14 including a plurality of medium accommodating cassettes 12 is provided below the printer unit 10. A medium P accommodated in the medium accommodating cassette 12 is sent to a recording area by the line head 20 through a feeding path 21 illustrated by a solid line of FIG. 1, and a recording operation is performed on the medium P. The medium on which recording has been performed by the line head 20 is sent to any one of a first discharge path 22 that is a path for discharging the medium to a post-recording discharge tray 13 provided above the line head 20 and a second discharge path 23 that is a path for sending the medium to the intermediate unit 3.

In FIG. 1, the first discharge path 22 is indicated by a broken line, and the second discharge path 23 is indicated by an one-dot chain line. The second discharge path 23 extends in a +Y direction of the recording unit 2, and delivers the medium to a reception path 30 of the adjacent intermediate unit 3.

Further, the recording unit 2 includes a reversing path 24 indicated by a two-dot chain line of FIG. 1, and is configured to be capable of double-sided recording in which after recording is performed on a first surface of the medium, the medium is reversed, and recording is performed on a second surface of the medium. Further, in each of the feeding path 21, the first discharge path 22, the second discharge path 23, and the reversing path 24, one or more roller pairs (not illustrated) are disposed as an example of an unit for transporting the medium.

The recording unit 2 is provided with a control unit 25 that controls an operation related to the transport and the recording of the medium in the recording unit 2. Further, the recording system 1 is configured such that the recording unit 2, the intermediate unit 3, the first unit 5, and the second unit 6 are mechanically and electrically coupled to each other, and the medium can be transported from the recording unit 2 to the second unit 6. The control unit 25 can control various operations of the intermediate unit 3 coupled to the recording unit 2, the first unit 5, and the second unit 6.

The recording system 1 is configured such that settings of the recording unit 2, the intermediate unit 3, the first unit 5, and the second unit 6 can be input from an operation panel which is not illustrated. The operation panel may be provided in the recording unit 2 as an example.

In Intermediate Unit

The intermediate unit 3 will be described with reference to FIG. 1. The intermediate unit 3 illustrated in FIG. 1 delivers the medium received from the recording unit 2 to the first unit 5. The intermediate unit 3 is disposed between the recording unit 2 and the first unit 5. The medium transported through the second discharge path 23 of the recording unit 2 is received by the intermediate unit 3 from the reception path 30, and is transported to the first unit 5. Further, the reception path 30 is illustrated by a solid line of FIG. 1.

In the intermediate unit 3, there are two transport paths through which the medium is transported. A first transport path is a path through which the medium is transported from the reception path 30 via a first switchback path 31 illustrated by a dotted line of FIG. 1 to a joining path 33. A second path is a path through which the medium is transported from the reception path 30 via a second switchback path 32 illustrated by a two-dot chain line of FIG. 1 to the joining path 33.

The first switchback path 31 is a path through which the medium is received in a direction of an arrow A1 and is then switched back in a direction of an arrow A2. The second switchback path 32 is a path through which the medium is received in a direction of an arrow B1 and is then switched back in a direction of an arrow B2.

The reception path 30 branches into the first switchback path 31 and the second switchback path 32 at a branching portion 35. The branching portion 35 is provided with a flap which is not illustrated that switches destination of the medium to either the first switchback path 31 or the second switchback path 32.

Further, the first switchback path 31 and the second switchback path 32 are joined at a joining portion 36. However, even when the medium is sent from the reception path 30 to either the first switchback path 31 or the second switchback path 32, the medium can be delivered to the first unit 5 through the common joining path 33.

The intermediate unit 3 receives the medium into the reception path 30 in a state in which the latest recording surface is headed to the upper side by the line head 20 from the recording unit 2. However, the medium is bent and reversed in the joining path 33, and thus the latest recording surface is headed to the lower side.

However, the medium in a state in which the latest recording surface is headed to the lower side is delivered from the +Y direction of the intermediate unit 3 to a first transport path 43 of the first unit 5.

Further, in each of the reception path 30, the first switchback path 31, the second switchback path 32, and the joining path 33, one or more roller pairs which are not illustrated are arranged as an example of an unit for transporting the medium.

When recording is continuously performed on a plurality of media in the recording unit 2, the medium that has entered the intermediate unit 3 is alternately sent to a transport path passing through the first switchback path 31 and a transport path passing through the second switchback path 32. This can increase a throughput of medium transport in the intermediate unit 3.

Further, in a case where the recording is performed by ejecting the ink (the liquid) to the medium as in the line head 20 of the present embodiment, when the processing is performed by the first unit 5 or the second unit 6 in a subsequent stage, if the medium is wet, the recording surface may be rubbed and the integrity of the medium may be poor.

By delivering the medium, on which recording has been performed, from the recording unit 2 via the intermediate unit 3 to the first unit 5, a transport time until the medium on which recording has been performed is sent to the first unit 5 can be made long, and the medium can be further dried until reaching the first unit 5 or the second unit 6.

In First Unit

Subsequently, the first unit 5 (the medium processing apparatus) will be described. The first unit 5 illustrated in FIG. 1 includes a reception unit 41 that receives the medium from the intermediate unit 3 on the lower side in a −Y direction. The medium transported along the joining path 33 of the intermediate unit 3 is input into the first unit 5 from the reception unit 41 and is delivered to the first transport path 43.

The first unit 5 includes the medium drying device 50 that performs the drying processing on the medium received from the reception unit 41 and the end stitching unit 42 as a processing unit that performs processing on the medium received from the reception unit 41 or the medium processed by the medium drying device 50.

The first unit 5 includes the first transport path 43 through which the medium received from the reception unit 41 is sent to the end stitching unit 42 and a second transport path 44 which branches from the first transport path 43 at a second branching unit D2 and through which the medium is sent to the medium drying device 50. The second branching portion D2 is provided with a flap which is not illustrated that switches a destination of the medium between the first transport path 43 and the second transport path 44.

For example, the end stitching unit 42 is a configuration unit that performs the end stitching processing of stitching the end of the medium, such as one corner of the medium and one side of the medium. As an example, the end stitching unit 42 includes a stapler.

The medium drying device 50 performs the drying processing on the medium. In the present embodiment, the medium drying device 50 dries the medium by heating the medium. Although a detailed configuration of the medium drying device 50 will be described later, the medium drying-processed by the medium drying device 50 is sent to either the end stitching unit 42 or the saddle stitching processing unit 70 provided in the second unit 6.

In the first unit 5 of the present embodiment, as illustrated in FIG. 1, the medium drying device 50 is located in a −Z direction, which is vertically below the end stitching unit 42. Further, although not illustrated, the medium drying device 50 and the end stitching unit 42 are arranged in a vertical direction, that is, are arranged to have an overlapping portion when viewed from the upper side.

The medium drying device 50 and the end stitching unit 42 are arranged in such a positional relationship, so that an increase in a horizontal dimension of the first unit 5 can be suppressed, and the device can be miniaturized.

Further, as illustrated in FIG. 1, the first unit 5 includes a punching processing unit 46 that performs punching processing on the medium received from the reception unit 41. The punching processing unit 46 is installed at a position, close to the reception unit 41, of the first transport path 43 through which the medium received by the first unit 5 passes, and is configured to be able to perform the punching processing upstream of the first transport path 43. The punching processing unit 46 is disposed vertically below the medium drying device 50. Further, although not illustrated, the punching processing unit 46 is also disposed to have a portion overlapping the medium drying device 50 and the end stitching unit 42 when viewed in a vertical direction (the Z axis direction), that is, when viewed from the top. Further, only the medium drying device 50 and the punching processing unit 46 may overlap each other or only the end stitching unit 42 and the punching processing unit 46 may overlap each other.

The medium received from the reception unit 41 can be sent to a processing tray 48 through the first transport path 43 illustrated in FIG. 1. The medium sent to the processing tray 48 may or may not have been punched by the punching processing unit 46. In the processing tray 48, the media are stacked on the processing tray 48 while rear ends of the media in a transport direction are aligned with each other. When a predetermined number of media P are stacked on the processing tray 48, the end stitching processing by the end stitching unit 42 is performed at rear ends of the media P. The first unit 5 includes a second discharge section 62 that discharges the medium in the +Y direction. Further, the first unit 5 includes a first discharge section 61 and a third discharge section 63 in addition to the second discharge section 62, and is configured to be able to discharge the medium from the first to third discharge sections 61, 62, and 63.

The medium processed by the end stitching unit 42 is placed on a first tray 40 as a tray that receives the medium discharged from the second discharge section 62, while being discharged from the second discharge section 62 to the outside of an apparatus body of the first unit 5 by a discharge unit which is not illustrated. The first tray 40 is provided to protrude from the first unit 5 in the +Y direction. In the present embodiment, the first tray 40 includes a base section 40*a* and an extension portion 40*b*, and the extension portion 40*b* is configured to be accommodatable in the base section 40*a*.

Further, a third transport path 45 branching from the first transport path 43 at a third branching portion D3 downstream of the second branching portion D2 is coupled to the first transport path 43. The third branching portion D3 is provided with a flap which is not illustrated that switches a destination of the medium between the first transport path 43 and the third transport path 45.

An upper tray 49 is provided at an upper portion of the first unit 5. The third transport path 45 continues from the third branching portion D3 to the third discharge section 63 which will be described below, and the medium transported through the third transport path 45 is discharged from the third discharge section 63 to the upper tray 49 by a discharge unit which is not illustrated. The medium punching-processed by the punching processing unit 46 can be placed on the upper tray 49. Further, the medium on which no punching processing is performed and no processing is performed after the recording can be stacked.

The first transport path 43 is provided with an overlapping path 64 which branches from the first transport path 43 at a first branching portion D1 and is rejoined to the first transport path 43 at a first junction portion G1. The overlapping path 64 constitutes an overlapping processing unit 47 that stacks two sheets of the media and sends the two media to the medium drying device 50 or the end stitching unit 42. A leading medium transported in advance is sent to the overlapping path 64, and a trailing medium transported through the first transport path 43 is joined to the first junction portion G1, so that the leading medium and the trailing medium can be transported downstream of the first junction portion G1 while overlapping each other. Further, the overlapping processing unit 47 may be configured to provide a plurality of overlapping paths 64 and to send three or more sheets of the media to the downstream side while the media overlap each other. In the first unit 5, while the overlapping processing unit 47 is located vertically below the medium drying device 50, the medium drying device 50, the end stitching unit 42, and the overlapping processing unit 47 partially overlap each other when viewed from the vertical direction, that is, when viewed from the upper surface. Further, only the medium drying device 50 and the overlapping processing unit 47 may overlap each other or only the end stitching unit 42 and the overlapping processing unit 47 may overlap each other.

In the first unit 5, one or more roller pairs which are not illustrated as an example of an unit that transports the medium are arranged in each of the first transport path 43, the second transport path 44, and the third transport path 45.

In Medium Drying Device

Next, the medium drying device 50 as a first processing unit will be described.

The medium on which the recording has been performed by ejecting the ink (the liquid) from the line head 20 of the recording unit 2 is dried by evaporating the ink to some extent while being transported through the intermediate unit 3. However, when the medium is not sufficiently dried, if a plurality of media are aligned with each other in order to perform the end stitching processing and the saddle stitching processing, the integrity may be poor. Before the medium illustrated in FIG. 1 is sent to the end stitching unit 42 and the saddle stitching processing unit 70, the medium can be dried in the medium drying device 50.

Figure 2:
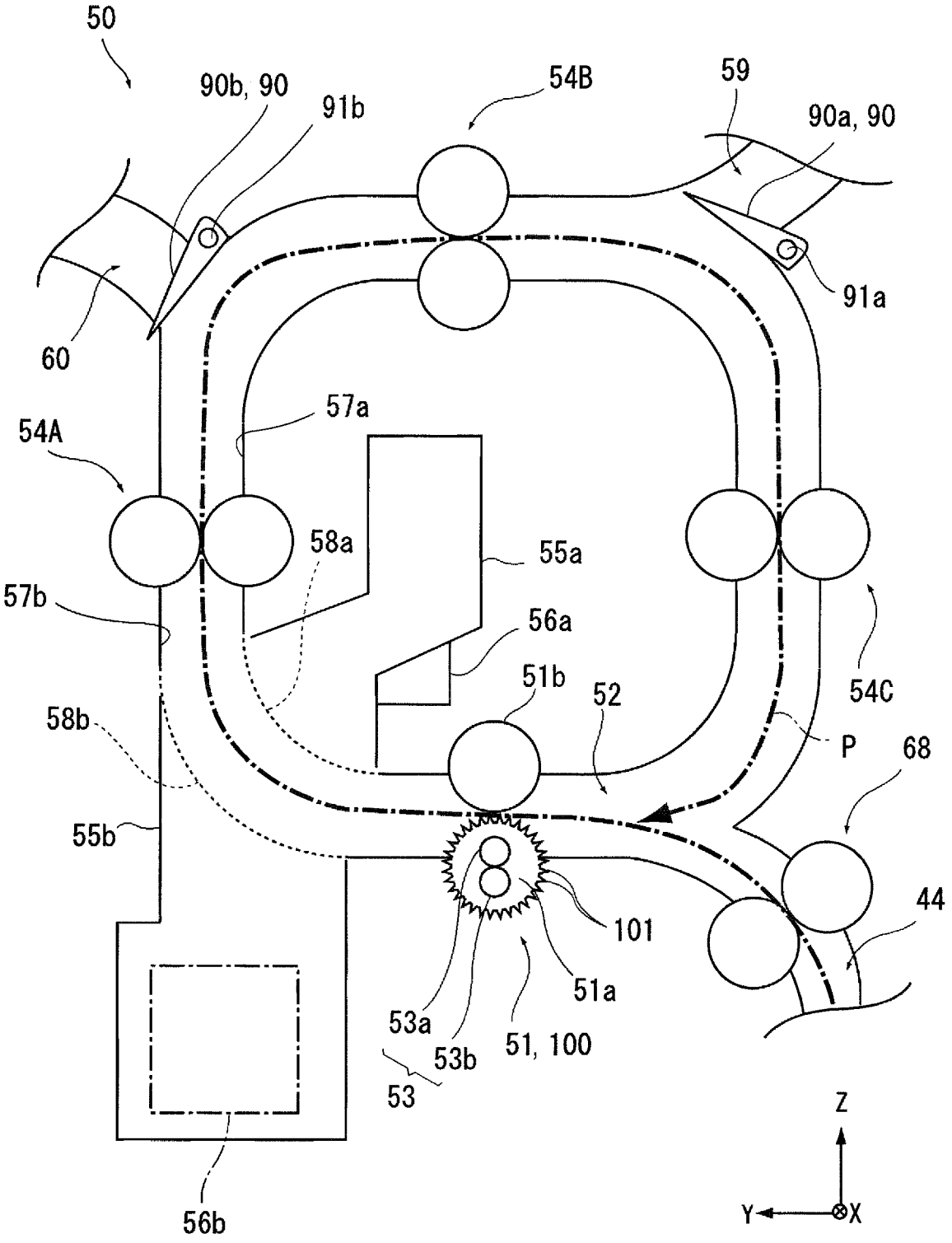
FIG. 2 is a schematic side view of a drying processing unit.

The medium drying device 50 illustrated in FIG. 2 includes a heat roller pair 51 (a drying roller pair) as a drying processing unit that dries the transported medium recorded by the line head 20 and a perforation portion 100 that forms a plurality of holes on an area including a recorded area of the medium. In the present embodiment, the perforation portion 100 also serves as the heat roller pair 51.

Hereinafter, a configuration of the heat roller pair 51 that also serves as a function of the perforation portion 100 will be described.

As illustrated in FIG. 2, the heat roller pair 51 is configured as a drying roller pair that holds the medium by a drying driving roller 51*a* driven by a driving source which is not illustrated and a drying driven roller 51*b* driven to rotate by rotation of the drying driving roller 51*a*.

In the present embodiment, the drying driving roller 51*a* is configured to be heated. Therefore, the medium can be heated while the medium is nipped and transported by the heat roller pair 51.

The drying driving roller 51*a* may include, as an example, an induction coil 53 therein and can be heated by an induction heating method of heating a roller by action of a magnetic field generated by causing a current to flow to the induction coil 53. Further, in addition to the induction heating method, for example, a halogen lamp can also be used as a heat source.

The drying driving roller 51*a* is made of, as an example, a metal material having high thermal conductivity. Further, the drying driven roller 51*b* is formed of an elastic material such as a sponge formed of a resin material.

The heating temperature of the drying driving roller 51*a* can be adjusted by turning on and off heating by the induction coil 53. Further, for example, the temperature can be adjusted by controlling a duty ratio of the current flowing through the induction coil 53. Further, the medium drying device 50 can be provided with a temperature detection unit which is not illustrated that detects the roller temperature of the drying driving roller 51*a*.

Figure 3:
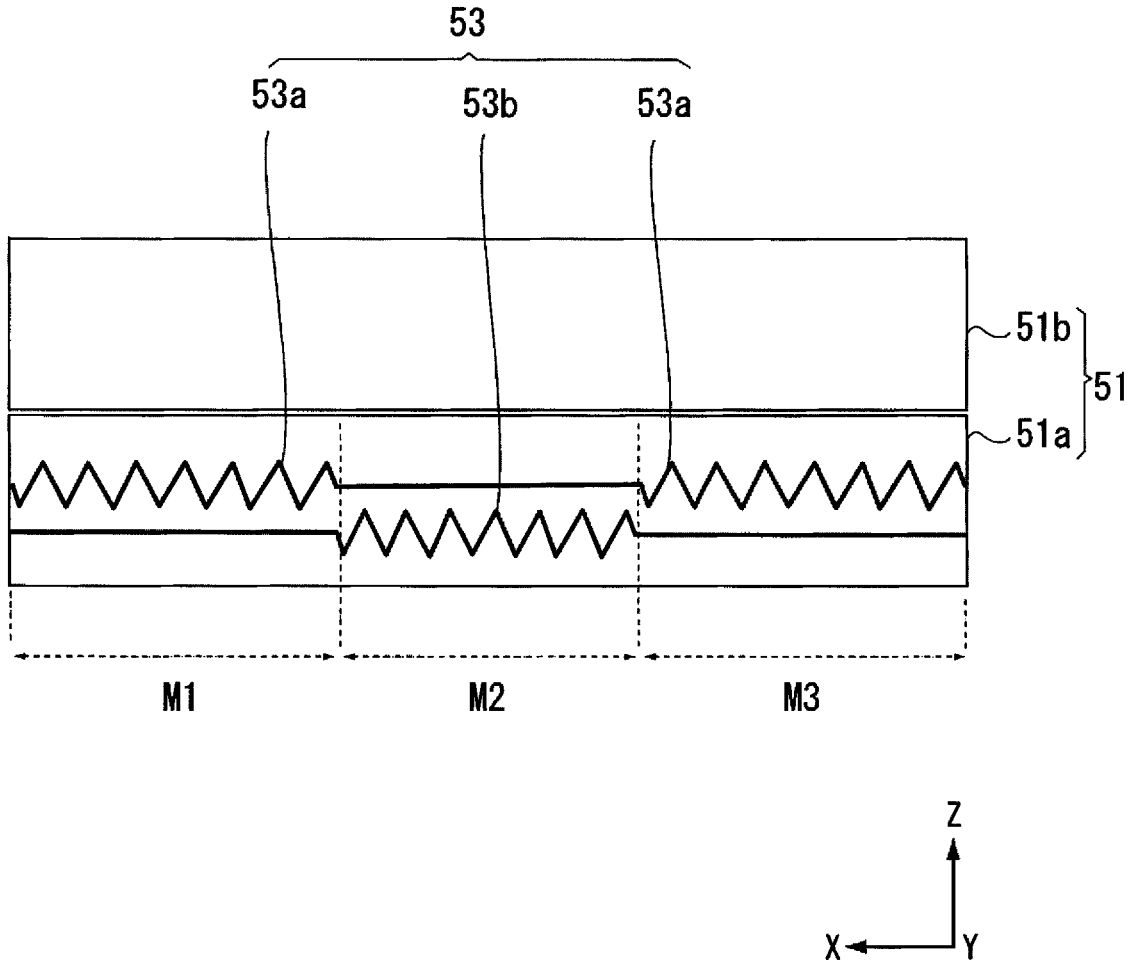
FIG. 3 is a diagram illustrating a configuration of a heat roller pair.

In the present embodiment, as illustrated in FIGS. 2 and 3, two coils of a first induction coil 53*a* and a second induction coil 53*b* are provided as the induction coil 53.

As illustrated in FIG. 3, the first induction coil 53*a* and the second induction coil 53*b* are disposed offset from each other in the X axis direction, which is the width direction of the medium. Accordingly, the heating area of the drying driving roller 51*a* is divided into a plurality of parts in the X axis direction.

In FIG. 3, the first induction coil 53*a* heats end areas M1 and M3 of the drying driving roller 51*a* in a medium width direction, and the second induction coil 53*b* heats an intermediate area M2 of the drying driving roller 51*a* in the medium width direction. With this configuration, the end areas M1 and M3 and the intermediate area M2 can be heated individually, and the heating areas in the medium width direction can be switched.

Further, three or more induction coils 53 having different heating areas in the medium width direction may be provided or the entire area in the medium width direction may be heated by one induction coil 53.

Further, as in the present embodiment, in the heat roller pair 51, at least one of the drying driving roller 51*a* and the drying driven roller 51*b* constituting the heat roller pair 51 may be heated or only the drying driven roller 51*b* may be heated.

Further, both the drying driving roller 51*a* and the drying driven roller 51*b* may be heated. When both the drying driving roller 51*a* and the drying driven roller 51*b* are heated, both surfaces of a paper sheet are heated, so that the paper sheet can be more certainly dried.

As described above, the medium sent from the intermediate unit 3 is input from the reception unit 41 via the first transport path 43 to the second transport path 44 of the first unit 5 illustrated in FIG. 1 in a state in which the latest recording surface faces the lower side. Then, the medium is nipped by the heat roller pair 51 in a state in which the latest recording surface faces the lower side. Therefore, among the heat roller pair 51 illustrated in FIGS. 2 and 3, the heated drying driving roller 51*a* comes into contact with the latest recording surface of the medium. That is, since the latest recording surface can be directly heated, the liquid component contained in the medium can be effectively heated, and the medium can be dried.

Figure 4:
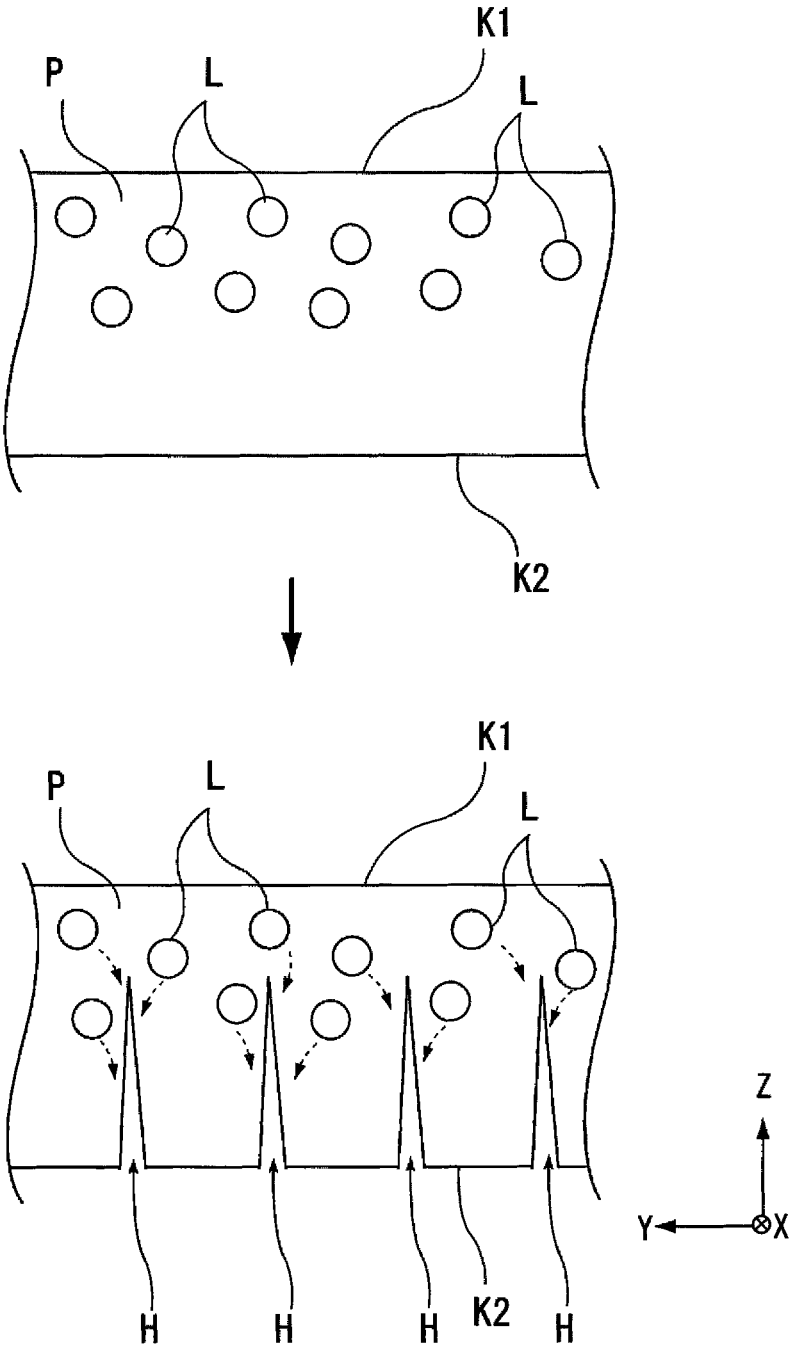
FIG. 4 is a diagram for illustrating a drying state when a plurality of holes are not formed in a medium and a drying state when the plurality of holes are formed in the medium.

Here, in FIG. 4, when the medium is denoted by reference sign P, a surface of the medium P, which the heated drying driving roller 51*a* contacts, is set as a second surface K2, and a surface of the medium P, which the drying driving roller 51*a* does not contact, is set as a first surface K1, after the medium P is transported by the heat roller pair 51, as illustrated in an upper view of FIG. 4, the liquid component L may remain near the center of the medium in a thickness direction (a Z axis direction of FIG. 4) or in a portion close to the first surface K1 which the drying driving roller 51*a* does not contact, and the medium P may not be dried sufficiently. When the drying driven roller 51*b* is also heated, the liquid component L is easily evaporated in the portion close to the first surface K1. However, the liquid component L may remain near the center of the medium in the thickness direction.

Thus, in the present embodiment, as illustrated in a lower view of FIG. 4, a plurality of holes H are formed in the medium P by the perforation portion 100. When the plurality of holes H are formed in the medium, the specific surface area increases, and thus the liquid component L is easily evaporated from the inside of the medium P. Accordingly, the medium P can be effectively dried by heating of the heat roller pair 51.

In Perforation Portion

Figure 5:
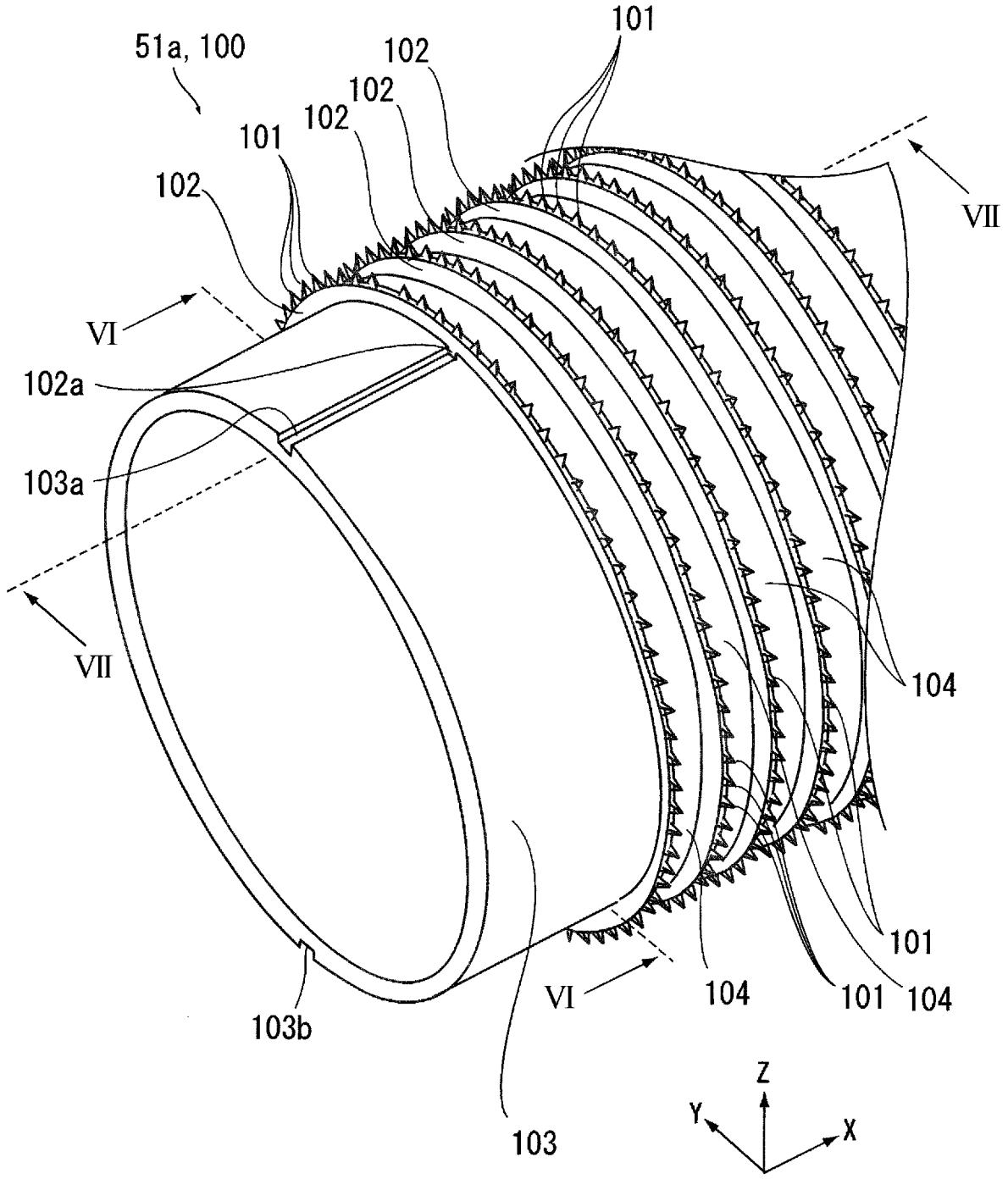
FIG. 5 is an enlarged perspective view of a main portion of a drying driving roller.

In the present embodiment, as illustrated in FIG. 5, in the heat roller pair 51 as the perforation portion 100, the drying driving roller 51*a* is provided with a plurality of piercing portions 101 that can pierce the medium P.

In more detail, the drying driving roller 51*a* is configured with a cylindrical base portion 103 formed of metal having thermal conductivity and a plurality of ring-shaped members 102 attached to the base portion 103. The ring-shaped member 102 has a plurality of piercing portions 101 in a circumferential direction of a ring.

The above-described induction coil 53 (the first induction coil 53*a* and the second induction coil 53*b*) is provided in a cylinder of the base portion 103. By attaching the ring-shaped member 102 to the base portion 103, the piercing portions 101 can be provided in the base portion 103.

The plurality of ring-shaped members 102 are attached to the base portion 103 at intervals in the X axis direction. In the present embodiment, the ring-shaped member 102 including the piercing portions 101 is formed of metal having thermal conductivity.

Figure 6:
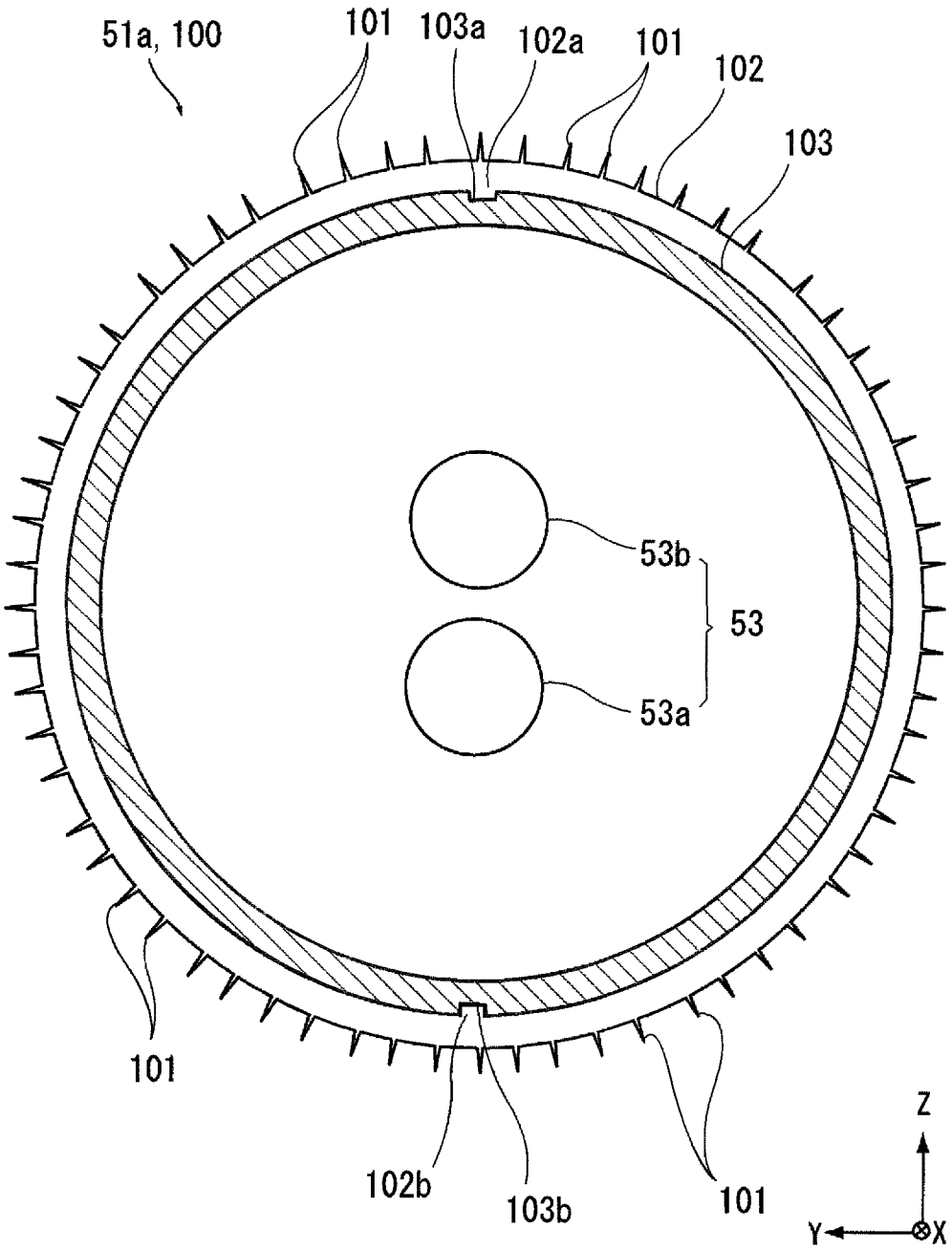
FIG. 6 is a cross-sectional view taken along arrow VI-VI of FIG. 5.

As illustrated in FIGS. 5 and 6, the base portion 103 includes a recess portion 103*a* and a recess portion 103*b* extending in the X axis direction. The ring-shaped member 102 includes a protrusion portion 102*a* and a protrusion portion 102*b* (FIG. 6) fitted to the recess portion 103*a* and the recess portion 103*b*. The recess portion 103*a* and the recess portion 103*b* are provided at positions opposite to each other in a circumferential direction. Further, similar to the recess portion 103*a* and the recess portion 103*b*, the protrusion portion 102*a* and the protrusion portion 102*b* are also provided at positions opposite to each other in the circumferential direction.

The ring-shaped member 102 is fixed to the base portion 103 in the circumferential direction by fitting the recess portion 103*a* and the protrusion portion 102*a* in each other or fitting the recess portion 103*b* and the protrusion portion 102*b* in each other.

Figure 7:
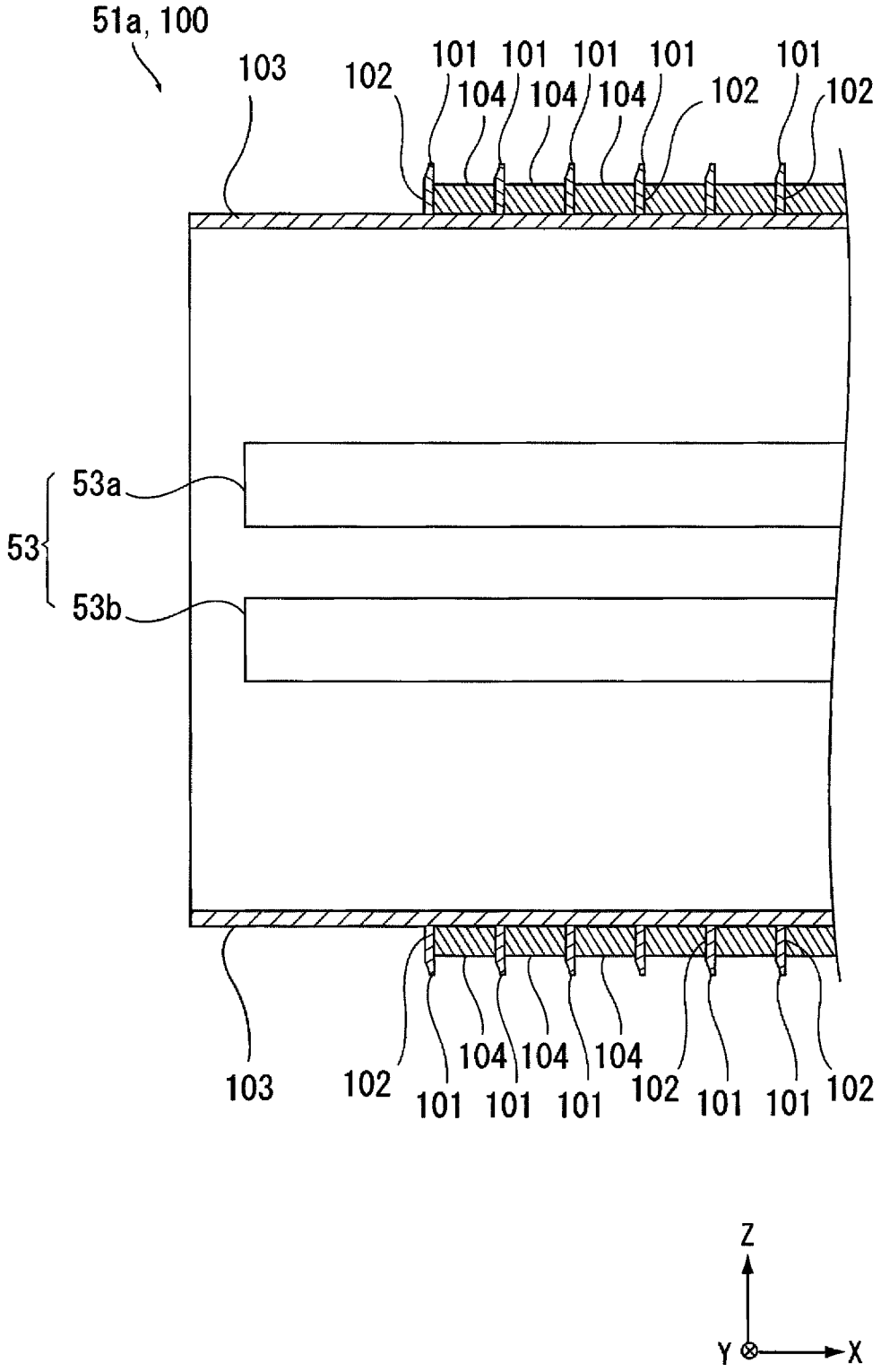
FIG. 7 is a cross-sectional view taken along arrow VII-VII of FIG. 5.

Further, as illustrated in FIGS. 5 and 7, a spacing member 104 that determines an interval between the ring-shaped members 102 is provided between the plurality of ring-shaped members 102 in the X axis direction. By arranging the plurality of ring-shaped members 102 through the spacing member 104, the plurality of ring-shaped members 102 can be provided at predetermined intervals in the X axis direction. It is preferable that the spacing member 104 is formed of a material having thermal conductivity. As the spacing member 104 has thermal conductivity, heat can be more efficiently transmitted to the piercing portions 101.

Instead of attaching the ring-shaped members 102 to the base portion 103, the surface of the base portion 103 may be cut and raised to directly form the piercing portions 101 in the base portion 103.

The piercing portions 101 are provided on one roller of the heat roller pair 51. Therefore, although the piercing portions 101 are provided not on the drying driving roller 51*a* but on the outer peripheral surface of the drying driven roller 51*b*, it is preferable that the piercing portions 101 are provided on the heated roller. By heating the roller on which the piercing portions 101 are provided, heat is applied to the inside of the medium when the medium is pierced by the piercing portions 101, so that the medium can be more effectively dried.

As the perforation portion 100 is provided in the heat roller pair 51 as a drying processing unit, when the medium is transported by the heat roller pair 51, the piercing portions 101 pierce the medium, so that a plurality of holes H can be formed in the medium P as illustrated in FIG. 4.

Since the heat roller pair 51 heats the medium P and forms the plurality of holes H in the medium P, the medium P can be effectively dried.

Further, since the medium P can be dried and perforated by the heat roller pair 51, the number of components can be reduced and the apparatus can be miniaturized.

Further, as illustrated in FIG. 2, the medium drying device 50 includes the heat roller pair 51 and a loop-like transport path 52 through which the medium can be transported circumferentially. The loop-like transport path 52 is formed with an inner path forming portion 57*a* and an outer path forming portion 57*b*, and the medium is transported through a space between the inner path forming portion 57*a* and the outer path forming portion 57*b*. The second transport path 44 branching from the first transport path 43 (FIG. 1) is joined to the loop-like transport path 52 upstream of the heat roller pair 51. Thus, the medium can be sent by a transport roller pair 68 provided in the second transport path 44 and can be introduced into the loop-like transport path 52.

The loop-like transport path 52 illustrated in FIG. 2 is provided with a first transport roller pair 54A, a second transport roller pair 54B, and a third transport roller pair 54C, through which the medium is transported, in addition to the heat roller pair 51. In the loop-like transport path 52, the medium is configured to be transported circumferentially. In FIG. 2, an one-dot chain line indicated by reference sign P indicates a trajectory of the medium which is input into the loop-like transport path 52 from the second transport path 44 to make one revolution.

After providing the loop-like transport path 52, by circumferentially transporting the medium a plurality of times, the drying processing by the heat roller pair 51 can be performed a plurality of times. Therefore, the medium can be dried more reliably.

Further, by providing the loop-like transport path 52, an increase in the size of the device can be suppressed without increasing the size of the transport path for performing the drying processing a plurality of times, as compared to, for example, a case where a plurality of the heat roller pairs 51 are provided in the transport path. Further, as compared to a case where the plurality of heat roller pairs 51 are provided in the transport path, a current supplied to a heat source of the heat roller pair 51 can be suppressed, and thus, an increase in power consumption can be suppressed.

Further, the piercing portions 101 are provided in the drying driving roller 51*a*. Thus, in the perforation portion 100, when the medium is transported through the loop-like transport path 52 illustrated in FIG. 2, the piercing portions 101 open holes from a surface of the loop-like transport path 52, which faces an outside of a loop.

As illustrated in a lower view of FIG. 4, when the medium P in which the holes H are opened from the second surface K2 is transported such that the second surface K2 faces the outside of the loop-like transport path 52, the medium P can be curved such that the holes H are opened in the loop-like transport path 52, and the liquid component L inside the medium P can be easily evaporated.

Another Configuration of Medium Drying Device

Figure 8:
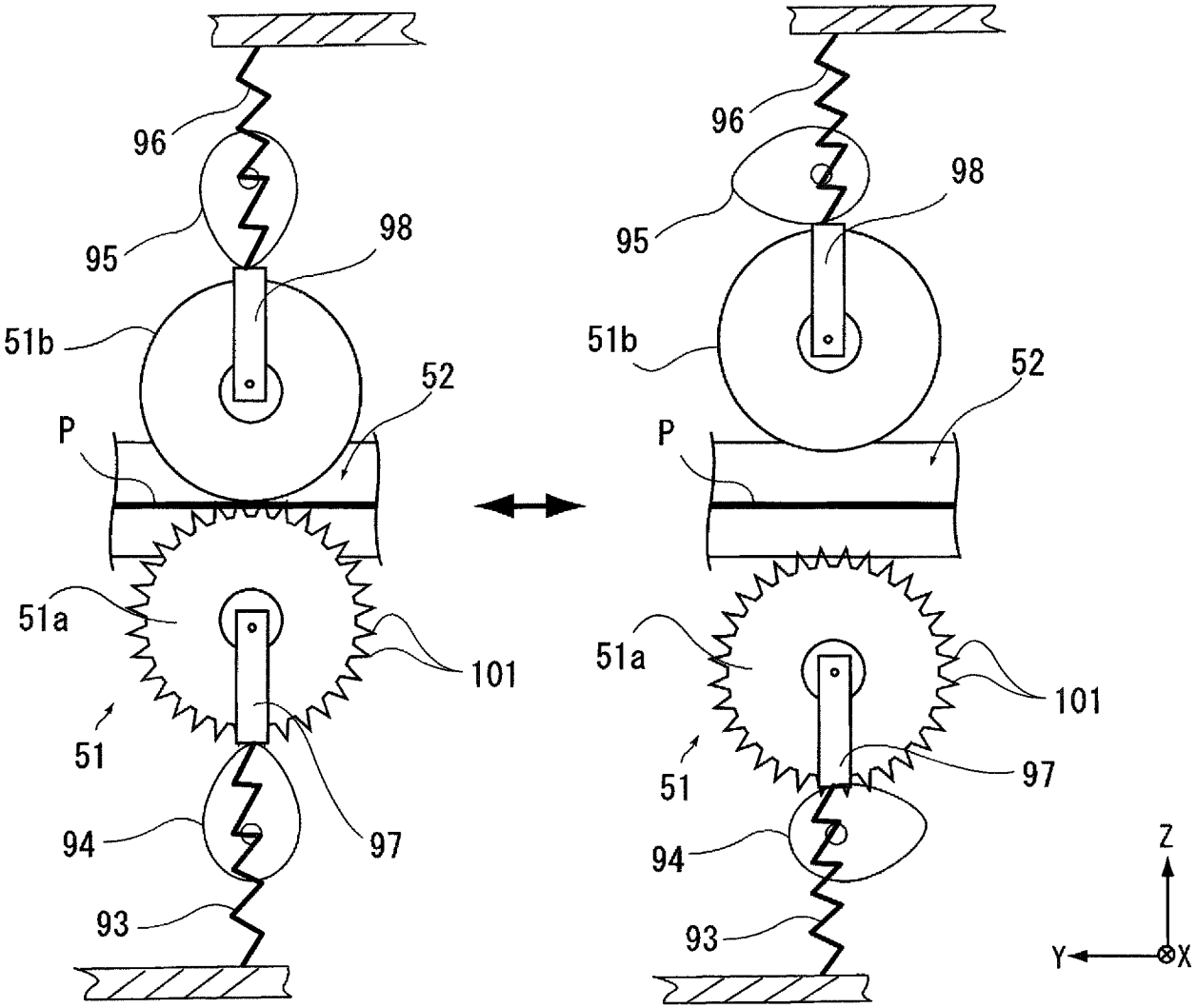
FIG. 8 is a diagram for illustrating a configuration for switching the drying driving roller between an advanced position and a retracted position.

In the heat roller pair 51, the drying driving roller 51*a*, in which the piercing portions 101 are provided, is configured to be displaceable between an advanced position where the piercing portions 101 pierce the medium P as illustrated in a left view of FIG. 8 and a retracted position where the piercing portions 101 do not pierce the medium as illustrated in a right view of FIG. 8.

As an example, the drying driving roller 51*a* is pressed by a first pressing member 93 such as a tension spring in a direction (the −Z direction) in which the drying driving roller 51*a* is retracted from the loop-like transport path 52. The first pressing member 93 is coupled to a first holder 97 that holds the drying driving roller 51*a*. Then, the drying driving roller 51*a* is configured to be displaceable in the Z axis direction by contacting the first holder 97 and rotating a first eccentric cam 94 by a driving source which is not illustrated. The rotation of the first eccentric cam 94 is controlled by the control unit 25, so that the drying driving roller 51*a* can be displaced between the advanced position (the left view of FIG. 8) and the retracted position (the right view of FIG. 8). The control unit 25 can detect the phase of the first eccentric cam 94 by an encoder which is not illustrated.

As the drying driving roller 51*a* is displaced between the advanced position and the retracted position, a state in which the piercing portions 101 pierce the medium P to form the holes H in the medium P and a state in which the piercing portions 101 do not pierce the medium P so as not to form the holes H in the medium P are switched.

The position of the drying driving roller 51*a* can be switched according to conditions. The conditions include the amount of the ink ejected to the medium during the recording by the recording unit 2, whether the recording on the medium is double-sided recording or single-sided recording, environmental conditions such as the temperature and the humidity during the drying, and the like.

For example, when it is not necessary to perform the drying processing on the medium due to a small amount of the ink ejected to the medium during the recording by the recording unit 2, the drying driving roller 51*a* can be placed at the retracted position so that the medium P is not heated.

Further, in FIG. 8, the drying driven roller 51*b* is configured to be pressed with a predetermined pressing force against the drying driving roller 51*a* in the advanced position. A second pressing member 96 such as a tension spring is provided between a second holder 98 that holds the drying driven roller 51*b* and a predetermined fixed position in the device. Then, the pressing force of the drying driven roller 51*b* against the drying driving roller 51*a* can be changed by rotating a second eccentric cam 95 which is in contact with the second holder 98 and is rotated by a driving source which is not illustrated.

Further, in FIG. 8, in order to easily identify a change of a state of the second pressing member 96, the drying driven roller 51*b* is largely retracted from the loop-like transport path 52. However, the drying driven roller 51*b* can be configured not to be retracted from the loop-like transport path 52.

By controlling the rotation of the first eccentric cam 94 by the control unit 25, the pressing force of the drying driven roller 51*b* against the drying driving roller 51*a* can be adjusted, and thus the nip pressure of the heat roller pair 51 can be adjusted. It is preferable that the nip pressure of the heat roller pair 51 is changed according to the conditions.

The conditions include, for example, the amount of the ink ejected to the medium during the recording by the recording unit 2, whether the recording on the medium is the double-sided recording or the single-sided recording, the environmental conditions such as the temperature and the humidity during the drying, and the like in addition to the type, the rigidity, the thickness, and the basis weight of the medium.

By controlling the heating by the heat roller pair 51 according to these conditions, the medium can be more properly dried. Control of the heating by the heat roller pair 51 includes, for example, the presence or absence of the heating, the temperature during the heating, whether or not to perform residual heat during the heating, a timing when the heating by the heat roller pair 51 starts, and the like.

Further, in the recording system 1, the heating by the heat roller pair 51 is controlled by the control unit 25 (FIG. 1). The control unit 25 can control the heating by the heat roller pair 51 according to the conditions. The same conditions as in the case of controlling the nip pressure of the heat roller pair 51 can be used as the conditions.

Further, as illustrated in FIG. 2, a first duct 55*a* and a second duct 55*b* are provided downstream of the heat roller pair 51 and upstream of the first transport roller pair 54A. The first duct 55*a* is suctioned by a first fan 56*a*, and the second duct 55*b* is sucked by a second fan 56*b*.

Portions of the inner path forming portion 57*a* and the outer path forming portion 57*b*, corresponding to the first duct 55*a* and the second duct 55*b*, are formed by an inner suction portion 58*a* and an outer suction portion 58*b* having holes through which air of the loop-like transport path 52 passes, so that the air of the loop-like transport path 52 can be suctioned by each duct.

The inner suction portion 58*a* and the outer suction portion 58*b* can be formed, for example, in a vertical grid along a medium transport direction, and can be provided with holes or can be formed in a mesh shape.

By providing the first duct 55*a* and the second duct 55*b*, it is possible to quickly discharge the vapor generated when the medium containing the ink (the liquid) is heated by the heat roller pair 51, to the outside of the apparatus.

In the loop-like transport path 52 illustrated in FIG. 2, a fourth transport path 59 is connected downstream of the second transport roller pair 54B and upstream of the third transport roller pair 54C. The fourth transport path 59 is a path that is joined to the first transport path 43 at a second junction portion G2 (see FIG. 1) and returns, to the first transport path 43, the medium drying-processed by the heat roller pair 51.

Further, in the loop-like transport path 52, a fifth transport path 60 is connected downstream of the first transport roller pair 54A and upstream of the second transport roller pair 54B. The fifth transport path 60 is a path coupled to the first discharge section 61 illustrated in FIG. 1 and is a path for feeding, toward the second unit 6, the medium drying-processed by the heat roller pair 51.

Further, the first unit 5 illustrated in FIG. 1 includes a switching flap 90 (FIG. 2) as a switching member that is switchable between a first state in which the medium processed by the medium drying device 50 is sent to the first discharge section 61 and a second state in which the medium processed by the medium drying device 50 is sent to the end stitching unit 42.

In the present embodiment, the switching flap 90 includes two flaps of a first switching flap 90*a* and a second switching flap 90*b*.

In more detail, in the loop-like transport path 52 illustrated in FIG. 2, the first switching flap 90*a* is provided in a connection portion with the fourth transport path 59 and the second switching flap 90*b* is provided at a connection portion with the fifth transport path 60.

The first switching flap 90*a* includes a first shaft portion 91*a* and is configured to be pivotable about the first shaft portion 91*a*. The second switching flap 90*b* includes a second shaft portion 91*b* and is configured to be pivotable about the second shaft portion 91*b*.

The first switching flap 90*a* and the second switching flap 90*b* are operated by a motor which is not illustrated or an electromagnetic clutch which is not illustrated, and the operation can be controlled by the control unit 25 provided in the recording unit 2 as an example.

When the medium is transported around the loop-like transport path 52, as illustrated in FIG. 2, the first switching flap 90*a* and the second switching flap 90*b* are in a posture of closing the fourth transport path 59 and the fifth transport path 60, respectively. Hereinafter, a state of the switching flap 90 illustrated in FIG. 2 is referred to as a circumferential state.

Figure 9:
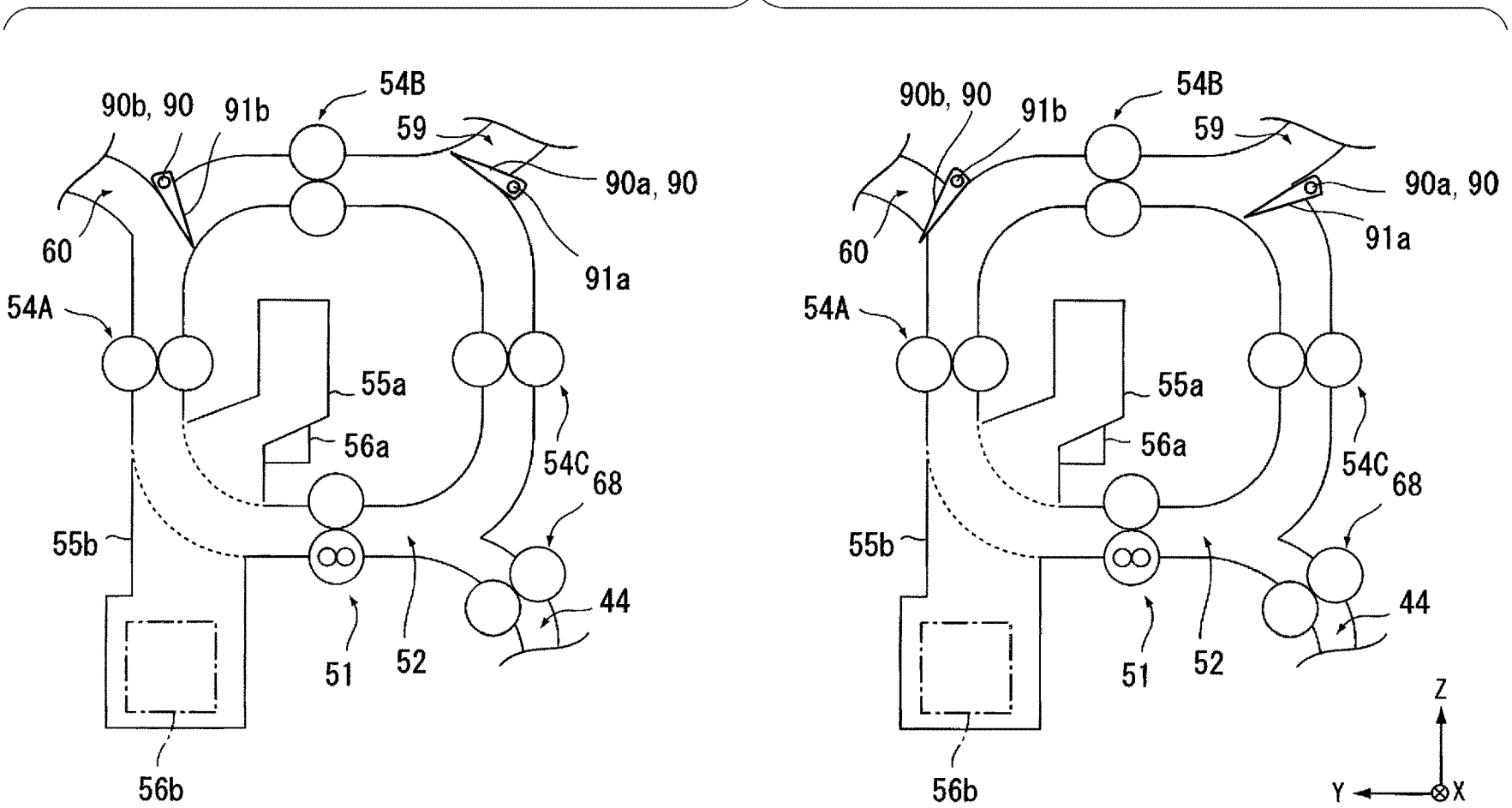
FIG. 9 is a diagram for illustrating an operation of a switching flap that switches between a first state in which the medium processed by a drying unit is sent to a first discharge section and a second state in which the medium processed by the drying unit is sent to an end stitching unit.

When the medium processed by the medium drying device 50 is sent to the first discharge section 61, that is, when the medium is sent to the fifth transport path 60, the switching flap 90 is brought into the first state illustrated in a left view of FIG. 9 from the circumferential state of FIG. 2. In the first state, the second switching flap 90*b* opens the fifth transport path 60, and swings in a posture of closing the loop-like transport path 52. The first switching flap 90*a* remains in a posture of closing the fourth transport path 59.

By setting the switching flap 90 in the first state, the medium drying-processed through the heat roller pair 51 can be sent to the fifth transport path 60, and the medium can be delivered from the first discharge section 61 to the second unit 6.

When the medium processed by the medium drying device 50 is sent to the end stitching unit 42, that is, when the medium is sent to the fourth transport path 59, the switching flap 90 is brought into the second state illustrated in a right view of FIG. 9 from the circumferential state of FIG. 2. In the second state, the first switching flap 90*a* opens the fourth transport path 59, and swings in a posture of closing the loop-like transport path 52. The second switching flap 90*b* remains in a posture of closing the fifth transport path 60.

By setting the switching flap 90 in the second state, the medium drying-processed by the heat roller pair 51 can be sent to the fourth transport path 59, and can be sent to the end stitching unit 42.

By providing the switching flap 90 as described above, the drying processing can be performed both when the medium is sent to the second unit 6 and when the medium is sent to the end stitching unit 42. Further, as illustrated in FIG. 1, the loop-like transport path 52 is accommodated within an area of the end stitching unit 42 (a second processing unit) when viewed from a horizontal direction. Further, although illustration is omitted, the length of the medium drying device 50 in the X axis direction is substantially the same as the length of the end stitching unit 42, and the loop-like transport path 52 is accommodated within the area of the end stitching unit 42 even in the X axis direction.

As the loop-like transport path 52 is accommodated within the area of the end stitching unit 42 when viewed from the horizontal direction, an increase in the horizontal dimension of the apparatus can be effectively suppressed, and the apparatus can be miniaturized.

Further, the medium drying device 50 may be configured not to have the loop-like transport path 52.

Further, in the present embodiment, the medium drying device 50 for drying the medium by heating the medium from the outside has been described. However, the medium drying device 50 may also be configured to dry the medium, for example, by blowing air to the medium.

Further, in the present embodiment, an apparatus in which a recording function is omitted from the recording system 1 may be regarded as a medium processing apparatus.

In Second Unit

Next, the second unit 6 as a saddle stitching unit will be described with reference to FIG. 1.

The second unit 6 is provided outside the apparatus body of the first unit 5, receives the medium discharged from the first discharge section 61, and performs the saddle stitching processing of stitching a central portion in the medium discharge direction (the +Y direction).

The medium delivered from the first discharge section 61 of the first unit 5 is transported along a transport path 69 indicated by a solid line of FIG. 1 and is sent to the saddle stitching processing unit 70. The saddle stitching processing unit 70 can perform the saddle stitching processing of stitching the bundle M of the media and then folding the bundle M of the media at a stitched position to make a booklet. The saddle stitching processing by the saddle stitching processing unit 70 will be described in detail below.

The bundle M of the media, which has been saddle-stitching-processed by the saddle stitching processing unit 70, is discharged to a second tray 65 illustrated in FIG. 1. The second tray 65 includes a regulation unit 66 at a tip end in the +Y direction that is the medium discharge direction, and it is suppressed that the bundle M of the media discharged to the second tray 65 protrudes from the second tray 65 in the medium discharge direction or falls from the second tray 65. Reference numeral 67 denotes a guide portion 67 that guides, to the second tray 65, the bundle M of the media discharged from the second unit 6.

In the present embodiment, the second unit 6 is configured to be detachable from a lower portion of the first tray 40 provided in the first unit 5.

With this configuration, it is possible to easily switch between a configuration having the second unit 6 and a configuration without the second unit 6 in the recording system 1 or the first unit 5 as the medium processing apparatus. Further, when the second unit 6 is mounted, the second unit 6 is located below the first tray 40. Thus, removal of the medium discharged to the first tray 40 by the second unit 6 cannot be prevented.

Next, a configuration around the saddle stitching processing unit 70 will be described with reference to FIGS. 1 and 10. The second unit 6 illustrated in FIG. 1 is provided with a feeding roller pair 75 as a feeding unit provided in the transport path 69 to transport the medium P, a stacking unit 71 on which the medium P is stacked, and the saddle stitching processing unit 70 that performs the saddle stitching processing on the medium stacked on the stacking unit 71. The saddle stitching processing unit 70 includes a stitching unit 72 that stitches the bundle M of the media including a plurality of sheets of media P stacked on the stacking unit 71 at the stitched position and a folding roller pair 73 as a folding unit that folds the bundle M of the media at the stitched position.

Figure 10:
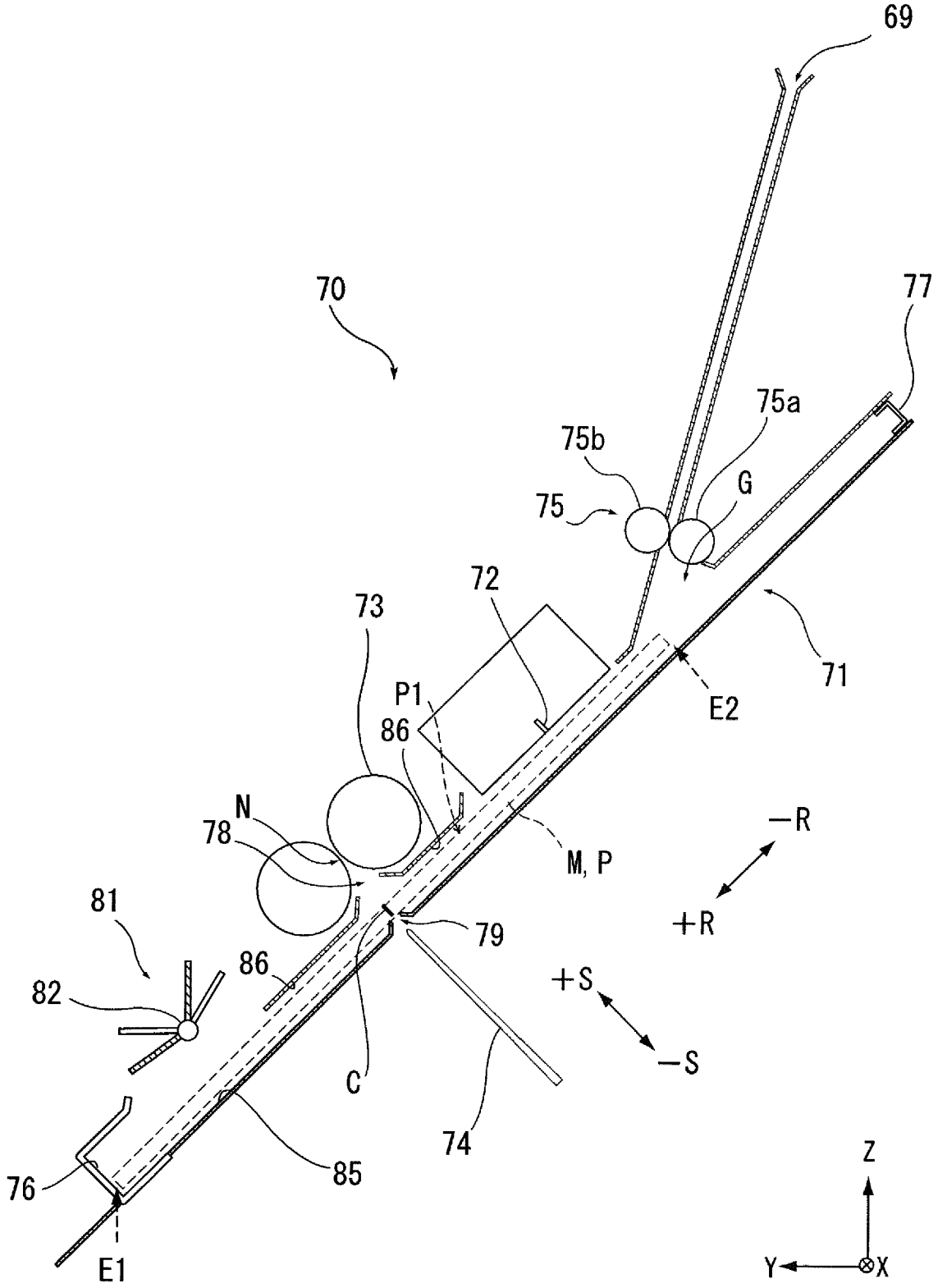
FIG. 10 is a side sectional view of a saddle stitching processing unit.

As illustrated in FIG. 10, the stacking unit 71 includes an alignment unit 76 that aligns a downstream end E1 of the stacked medium P and a paddle 81. The feeding roller pair 75 includes a driving roller 75*a* driven by a driving source which is not illustrated and a driven roller 75*b* driven to rotate by rotation of the driving roller 75*a*. The driving roller 75*a* is controlled and rotated by the control unit 25.

In FIG. 10, the stacking unit 71 receives and stacks the medium P transported by the feeding roller pair 75, between a support surface 85 that supports the medium P in an inclined posture in which a downstream side of a transport direction +R faces the lower side and an opposite surface 86 opposite to the support surface 85. The paddle 81 is provided between the feeding roller pair 75 and the alignment unit 76 in the transport direction +R and is rotated about a rotary shaft 82 while contacting the medium P, to move the medium P to the alignment unit 76.

In FIG. 10, reference sign G indicates a junction position G where the transport path 69 and the stacking unit 71 are joined to each other. Further, in the present embodiment, the stitched position is a central portion C of the medium P stacked on the stacking unit 71 in the transport direction +R. The medium P is sent from the transport path 69 to the stacking unit 71 by the feeding roller pair 75.

The stacking unit 71 is provided with the alignment unit 76 that can come into contact with a downstream end E1 of the medium P stacked on the stacking unit 71 in the transport direction +R and an abutting unit 77 that can come into contact with a downstream end E2 of the medium P stacked on the stacking unit 71 in the transport direction +R.

The alignment unit 76 and the abutting unit 77 are configured to be movable in both the transport direction +R of the medium P and an opposite direction −R thereto in the stacking unit 71 illustrated in FIG. 10. The alignment unit 76 and the abutting unit 77 can be moved in the transport direction +R or the opposite direction −R using, for example, a rack and pinion mechanism, a belt moving mechanism, or the like operated by power of a driving source which is not illustrated. The movement of the alignment unit 76 and the abutting unit 77 will be described in detail when a stacking operation of the stacking unit 71 is described.

The stitching unit 72 that stitches the bundle M of the media stacked on the stacking unit 71 at a predetermined position in the transport direction +R is provided downstream of the junction position G. The stitching unit 72 is a stapler as an example. A plurality of the stitching units 72 are provided at intervals in the X axis direction that is the width direction of the medium. As described above, the stitching unit 72 is configured to stitch the bundle M of the media with a central portion C of the bundle M of the media as the stitched position in the transport direction +R.

In FIG. 10, the folding roller pair 73 is provided downstream of the stitching unit 72. The opposite surface 86 is open at a position corresponding to a nip position N of the folding roller pair 73, and an approach path 78 of the bundle M of the media is formed from the stacking unit 71 to the folding roller pair 73. A slope that guides the central portion C that is the stitched position from the stacking unit 71 to the nip position N is formed at an entrance of the approach path 78 of the opposite surface 86.

Figure 12:
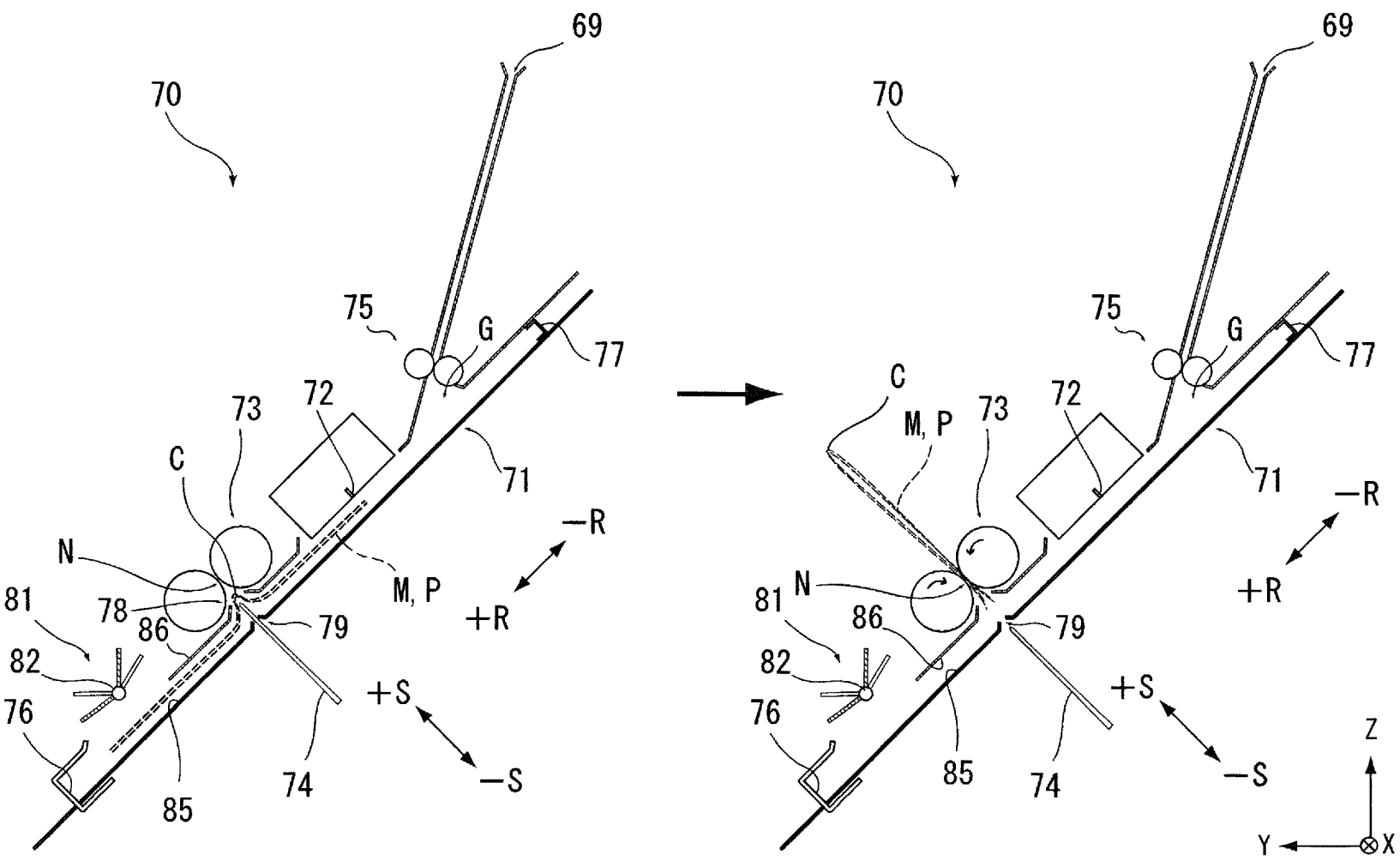
FIG. 12 is a diagram illustrating the saddle stitching processing in the saddle stitching processing unit.

A blade 74, which can switch between a retracted state in which the blade 74 is retracted from the stacking unit 71 as illustrated in FIG. 10 and an advanced state in which the blade 74 is advanced with respect to the stitched position of the bundle M of the media stacked on the stacking unit 71 as illustrated in a left view of FIG. 12, is provided on an opposite side to the folding roller pair 73 with the stacking unit 71 interposed therebetween. Reference numeral 79 is a hole 79 provided on the support surface 85, and the blade 74 can pass through the hole 79.

In Transport of Medium During Saddle Stitching Processing

Next, a basic flow in which in the second unit 6, the medium P is transported, is saddle-stitching-processed, and is discharged will be described with reference to FIGS. 10 to 12.

In FIG. 10, the medium P transported to the stacking unit 71 moves toward the alignment unit 76 by a self-weight thereof, and the paddle 81 is rotated whenever the one medium P is transported, so that the medium P is abutted against the alignment unit 76.

FIG. 10 shows a state in which a plurality of the media P stacked on the stacking unit 71 are stacked as the bundle M of the media.

Further, when the medium is received in the stacking unit 71, as illustrated in FIG. 10, the alignment unit 76 is disposed such that a distance from the junction position G between the transport path 69 and the stacking unit 71 to the alignment unit 76 is longer than the length of the medium P. Accordingly, the upstream end E2 of the medium P transported from the transport path 69 does not remain in the transport path 69, and the medium P is received by the stacking unit 71. The position of the alignment unit 76 in the transport direction +R of the stacking unit 71 may be changed according to the size of the medium P.

When a predetermined number of media P are stacked on the stacking unit 71, the stitching processing is performed in which the central portion C of the bundle M of the media in the transport direction +R is stitched by the stitching unit 72. At a time point when the transport of the medium P from the transport path 69 to the stacking unit 71, as illustrated in FIG. 10, since the central portion C deviates from the position of the stitching unit 72, the alignment unit 76 is moved in the −R direction as illustrated in a left view of FIG. 11, so that the central portion C of the bundle M of the media is disposed at a position facing the stitching unit 72. Further, the abutting unit 77 is moved in the +R direction to come into contact with the upstream end E2 of the bundle M of the media. The downstream end E1 and the upstream end E2 of the bundle M of the media are aligned by the alignment unit 76 and the abutting unit 77, so that the central portion C of the bundle M of the media is stitched by the stitching unit 72.

Figure 11:
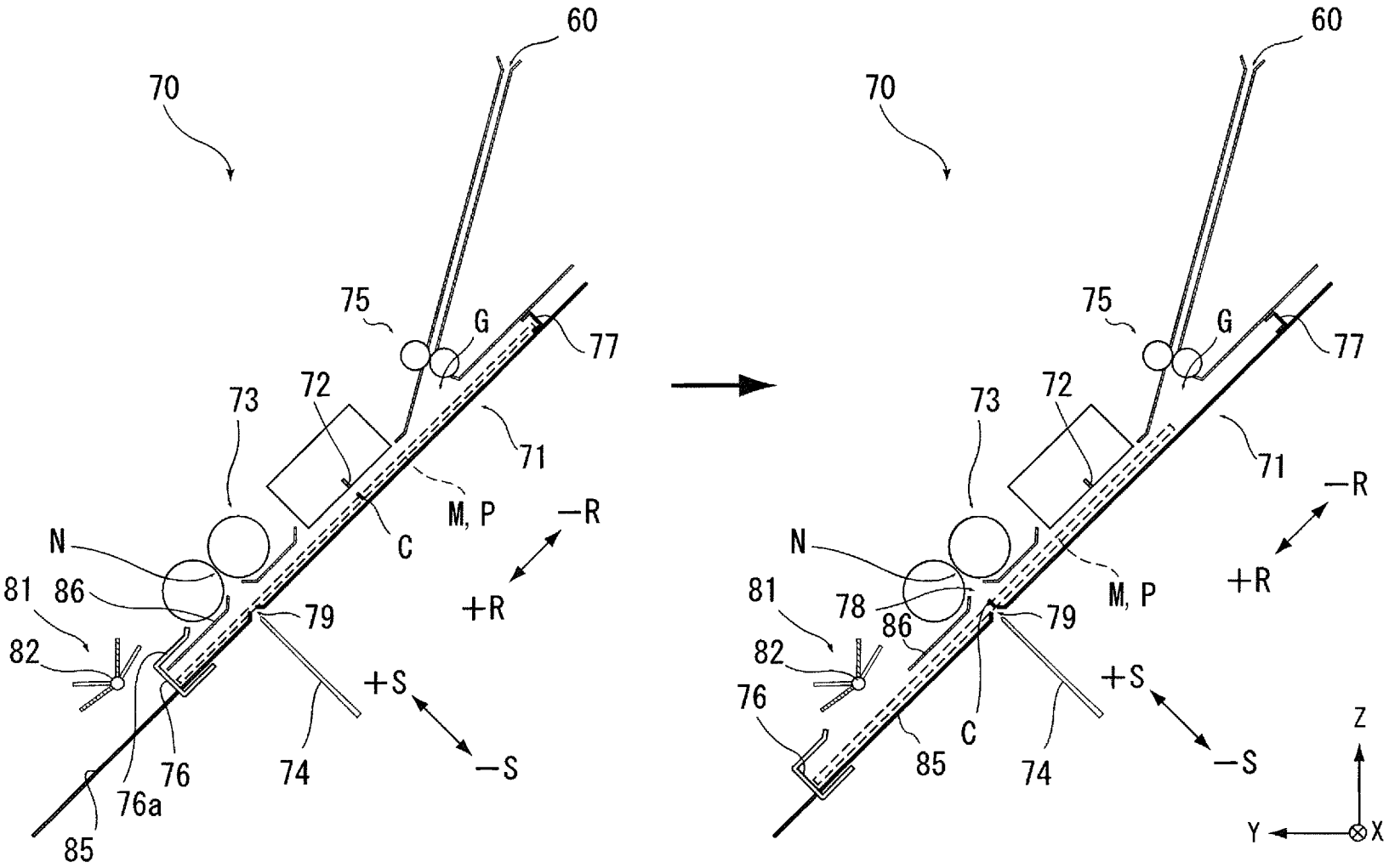
FIG. 11 is a diagram illustrating saddle stitching processing in the saddle stitching processing unit.

When the bundle M of the media is stitched by the stitching unit 72, as illustrated in a right view of FIG. 11, the alignment unit 76 is moved in the +R direction, and the bundle M of the media is moved such that the stitched central portion C is disposed at a position facing the nip position N of the folding roller pair 73. While a state in which the bundle M of the media is in contact with the alignment unit 76 is maintained by a self-weight thereof, only the alignment unit 76 is moved in the +R direction, so that the bundle M of the media can be moved in the +R direction. Further, the abutting unit 77 may be moved in the +R direction to maintain a state in which the abutting unit 77 is in contact with the upstream end E2 of the bundle M of the media.

Next, when the central portion C of the bundle M of the media is disposed at a position facing the nip position N of the folding roller pair 73, as illustrated in a left view of FIG. 12, the blade 74 is advanced in a +S direction to bend the central portion C toward the folding roller pair 73. The bent central portion C of the bundle M of the media is moved toward the nip position N of the folding roller pair 73 through the approach path 78.

When the central portion C of the bundle M of the media is nipped by the folding roller pair 73, the folding roller pair 73 is rotated. As illustrated in a right view of FIG. 12, the bundle M of the media is discharged toward the second tray 65 (FIG. 1) while being folded at the central portion C by the nip pressure of the folding roller pair 73.

Further, after the central portion C is nipped by the folding roller pair 73, the alignment unit 76 is moved in the +R direction, returns to the state of FIG. 10, and prepares for reception of a next medium P in the stacking unit 71.

Further, the transport path 69 may be provided with a folding stripe forming unit that attaches a folding stripe to the central portion C of the medium P. By attaching the folding stripe to the central portion C that is a folded position by the folding roller pair 73, the bundle M of the media can be easily folded at the central portion C.

Second Embodiment

Figure 13:
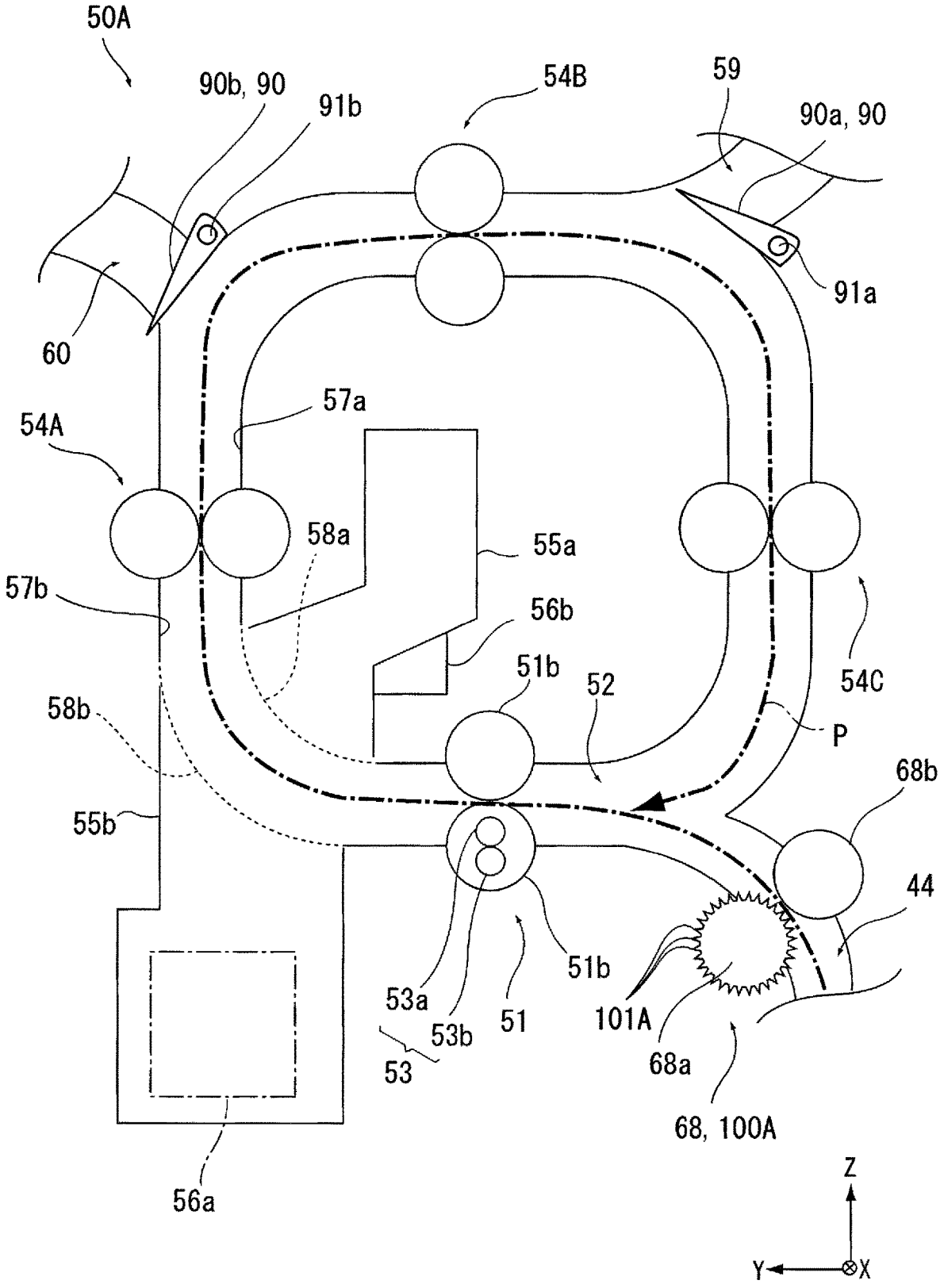
FIG. 13 is a schematic view illustrating a medium drying device according to a second embodiment.

A second embodiment will be described with reference to FIG. 13. Further, in the following embodiments, the same components as those of the first embodiment are denoted by the same reference numerals, and description of the components will be omitted.

In the medium drying device 50A according to the second embodiment, the piercing portions 101A constituting the perforation portion 100A are provided not on the heat roller pair 51 but on another roller pair.

In the present embodiment, the piercing portions 101A are provided on an outer peripheral surface of a transport driving roller 68*a* of the transport roller pair 68 provided in the second transport path 44, and the transport roller pair 68 also serves as the perforation portion 100A. The transport roller pair 68 holds the medium between the transport driving roller 68*a* that is rotationally driven and the transport driven roller 68*b* that is driven to rotate by the rotation of the transport driving roller 68*a*, and transports the medium toward the heat roller pair 51. When the medium is transported by the transport roller pair 68, the piercing portions 101A can pierce the medium, and a plurality of the holes H can be formed in the medium.

Further, a configuration in which the piercing portions 101A are provided in the transport driving roller 68*a* may be the same as a configuration in which the piercing portions 101 are provided in the drying driving roller 51*a* according to the first embodiment. Since the transport driving roller 68*a* is not heated, a material having low thermal conductivity can be used as a material for forming the piercing portions 101.

In the present embodiment, the piercing portions 101A are provided in the transport driving roller 68*a*, that is, the perforation portion 100A is disposed upstream of the heat roller pair 51 in the medium transport direction. As the perforation portion 100A is located upstream of the heat roller pair 51, the plurality of holes H (FIG. 4) can be formed in the medium before the drying by the heat roller pair 51 is performed. Thus, the medium can be effectively dried by the heat roller pair 51.

Further, although the piercing portions 101A can be provided on an outer peripheral surface of the transport driven roller 68*b*, it is preferable that the piercing portions 101A is provided in the transport driving roller 68*a* that is in contact with the latest recording surface of the recording unit 2.

Further, in the present embodiment, the configuration in which the transport roller pair 68 provided upstream of the heat roller pair 51 also serves as the perforation portion 100A has been described. However, the perforation portion 100A may be provided downstream of the heat roller pair 51.

Further, the piercing portions 101A may be provided in any one of the first transport roller pair 54A, the second transport roller pair 54B, and the third transport roller pair 54C, which transport the medium in the loop-like transport path 52, to form the perforation portion 100A.

Further, the transport driving roller 68*a* including the piercing portions 101A can also be configured to be displaceable between the advanced position where the piercing portions 101A pierce the medium and the retracted position where the piercing portions 101A do not pierce the medium, which is like the drying driving roller 51*a* described in the first embodiment and illustrated in FIG. 8.

Third Embodiment

A third embodiment will be described with reference to FIG. 14.

Figure 14:
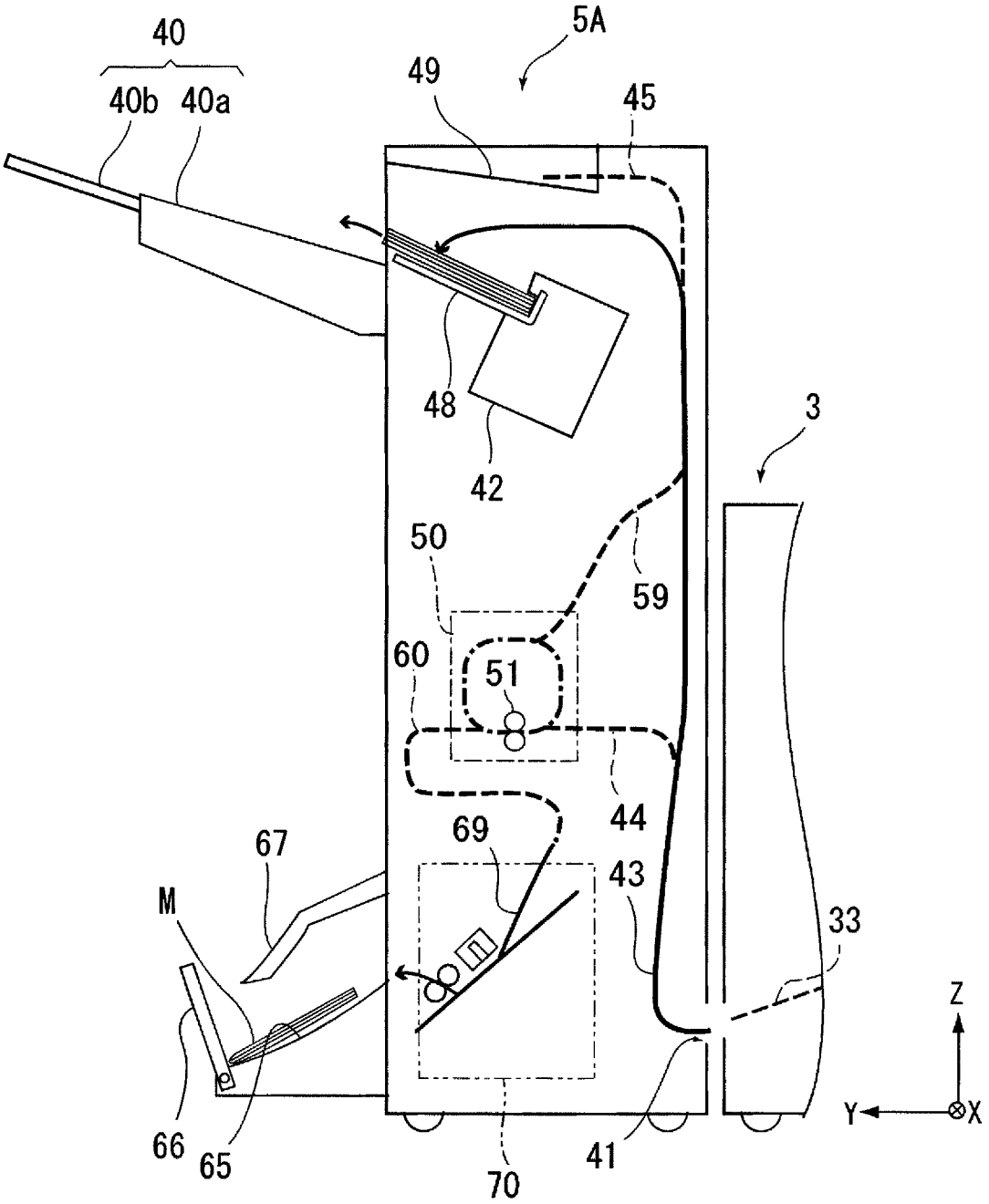
FIG. 14 is a schematic view illustrating a first unit according to a third embodiment.

The first unit 5A illustrated in FIG. 14 as the medium processing apparatus according to the third embodiment includes the medium drying device 50, the end stitching unit 42, and the saddle stitching processing unit 70, which have been described in the first embodiment, in one unit.

As illustrated in FIG. 14, in the first unit 5A, the saddle stitching processing unit 70 is positioned in the −Z direction that is a vertically downward direction of the medium drying device 50, that is, the end stitching unit 42, the medium drying device 50, and the saddle stitching processing unit 70 are arranged in the order thereof from the upper side. Further, although illustration is omitted, the end stitching unit 42, the medium drying device 50, and the saddle stitching processing unit 70 partially overlap each other even in the X axis direction. The medium drying device 50, the end stitching unit 42, and the saddle stitching processing unit 70 are arranged to have overlapping portions when viewed from a vertical direction, that is, when viewed from the upper side. Further, only the medium drying device 50 and the saddle stitching processing unit 70 may overlap each other or only the end stitching unit 42 and the saddle stitching processing unit 70 may overlap each other.

As the end stitching unit 42, the medium drying device 50, and the saddle stitching processing unit 70 are arranged in one unit, while an increase in the horizontal dimension of the apparatus is suppressed and the apparatus is miniaturized, all of the drying processing, the end stitching processing, and the saddle stitching processing can be performed by one apparatus.

Figure 15:
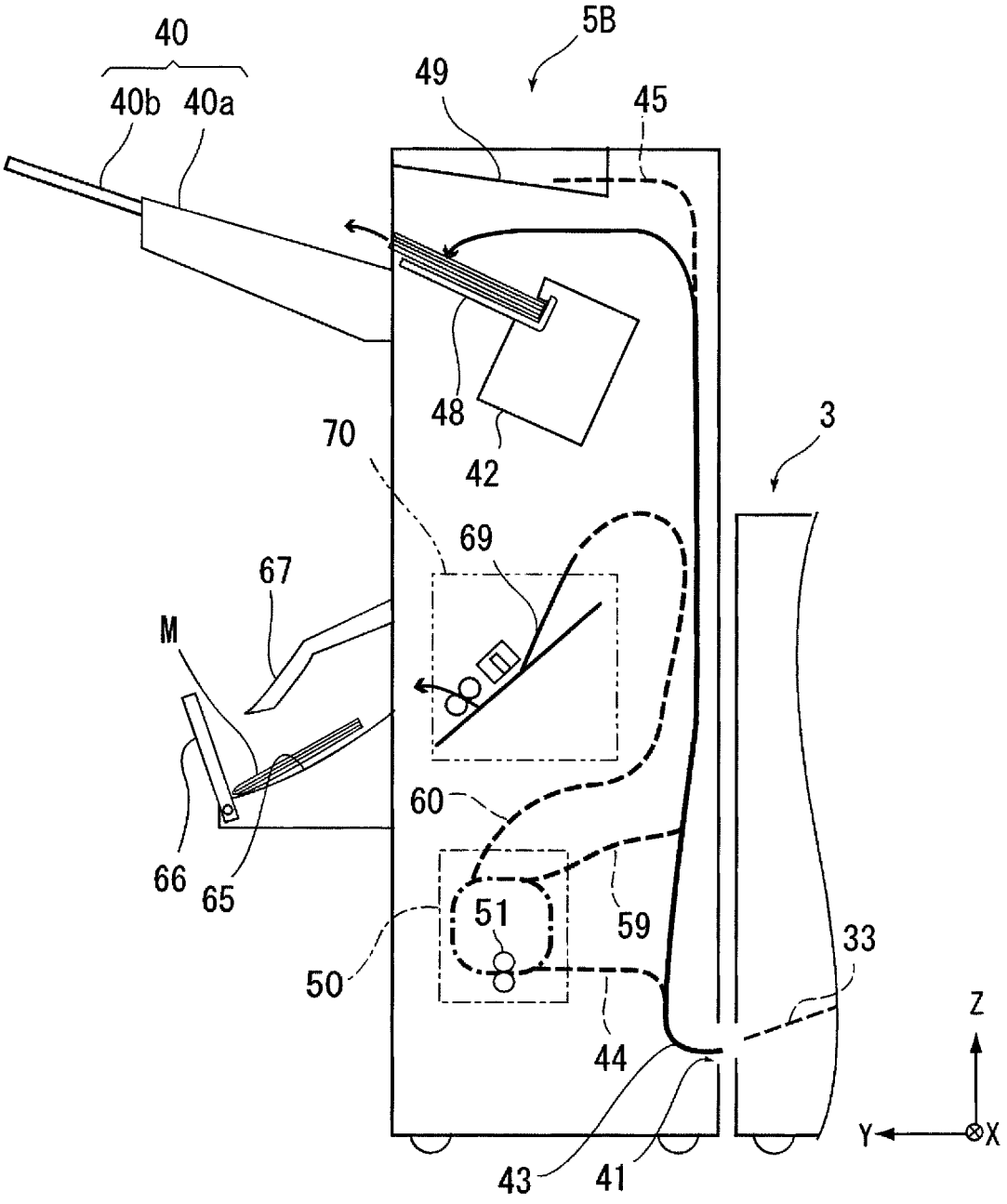
FIG. 15 is a schematic view illustrating another example of the first unit according to the third embodiment.

Further, when the end stitching unit 42, the medium drying device 50, and the saddle stitching processing unit 70 are provided in one unit, not only arrangement as illustrated in FIG. 14, as in the first unit 5B illustrated in FIG. 15, the saddle stitching processing unit 70 may be located between the medium drying device 50 and the end stitching unit 42 in the vertical direction, that is, the end stitching unit 42, the saddle stitching processing unit 70, and the medium drying device 50 may be arranged in the order thereof from the upper side. Even in this case, as the medium drying device 50, the end stitching unit 42, and the saddle stitching processing unit 70 are arranged to have overlapping portions when viewed from the vertical direction, that is, when viewed from the upper side, the increase in the horizontal dimension of the apparatus can be suppressed and the apparatus can be miniaturized. Further, even in this case, only the medium drying device 50 and the saddle stitching processing unit 70 may overlap each other or only the end stitching unit 42 and the saddle stitching processing unit 70 may overlap each other.

In the first unit 5A illustrated in FIG. 14 or the first unit 5B illustrated in FIG. 15, the medium drying device 50A according to the second embodiment may be disposed instead of the medium drying device 50.

Further, it is apparent that the present disclosure is not limited to the above-described embodiments, various modifications can be made without departing from the scope of the present disclosure described in the appended claims, and the modifications are also included in the scope of the present disclosure.

What is claimed is:

1. A medium drying device comprising:

a drying processing unit configured to dry a medium recorded by a recording section and transported; and a perforation portion configured to form a plurality of holes in the medium that has been recorded on by the recording section, the plurality of holes formed in a medium area to which liquid has been applied by the recording section.

2. The medium drying device according to claim 1, wherein the drying processing unit includes a drying roller pair that holds the medium between a drying driving roller that is rotationally driven and a drying driven roller that is driven to rotate by the rotation of the drying driving roller and transports the medium, and one or both of the drying driving roller and the drying driven roller are heated.

3. The medium drying device according to claim 2, wherein the perforation portion includes a plurality of piercing portions that are configured to pierce the medium, and the piercing portions are provided on an outer peripheral surface of one of the drying driving roller and the drying driven roller.

4. The medium drying device according to claim 3, wherein the roller, on which the piercing portions are provided, is heated.

5. The medium drying device according to claim 1, wherein the perforation portion is disposed upstream of the drying processing unit in a medium transport direction.

6. The medium drying device according to claim 1, further comprising:

a transport roller pair that is configured to hold the medium between a transport driving roller that is rotationally driven and a transport driven roller that is driven to rotate by the rotation of the transport driving roller, wherein the perforation portion includes a plurality of piercing portions that are configured to pierce the medium, and the piercing portions being provided on an outer peripheral surface of one of the transport driving roller and the transport driven roller.

7. The medium drying device according to claim 6, wherein the roller, on which the piercing portions are provided, is configured to be displaced between an advanced position where the piercing portions pierce the medium and a retracted position where the piercing portions do not pierce the medium.

8. The medium drying device according to claim 1, further comprising:

a loop-like transport path that includes the drying processing unit and is configured to circumferentially transport the medium.

9. The medium drying device according to claim 8, wherein when the medium is transported through the loop-like transport path, the perforation portion perforates a hole from a surface facing an outside of a loop.

10. A medium processing apparatus comprising:

a reception unit that is configured to receive a medium to be processed;

the medium drying device according to claim 1, which is configured to perform drying processing on the medium received from the reception unit; and a processing unit that is configured to perform processing on the medium received from the reception unit or the medium drying-processed by the medium drying device.

11. The medium processing apparatus according to claim 10, further comprising:

a saddle stitching processing unit that is configured to stitch a central portion of the medium drying-processed by the medium drying device, in a medium transport direction.

12. The medium processing apparatus according to claim 10, further comprising:

a first discharge unit that is configured to discharge the medium drying-processed by the medium drying device to an outside of an apparatus body;

a second discharge unit that is configured to discharge the medium processed by the processing unit to the outside of the apparatus body; and a tray that is configured to receive the medium discharged from the second discharge unit, wherein a saddle stitching unit that is provided outside the apparatus body, and is configured to receive the medium discharged from the first discharge unit, to stitch a central portion of the medium in a medium discharge direction, and to be attached to and detached from a lower portion of the tray.

13. A recording system comprising:

a recording unit including the recording section; and the medium processing apparatus according to claim 10, which is configured to process a medium after recording by the recording section.

14. A medium drying device comprising:

a drying processing unit configured to dry a medium recorded by a recording section and transported; and a perforation portion configured to form a plurality of holes in the medium that has been recorded on by the recording section, a transport roller pair that is configured to hold the medium between a transport driving roller that is rotationally driven and a transport driven roller that is driven to rotate by the rotation of the transport driving roller, wherein the perforation portion includes a plurality of piercing portions that are configured to pierce the medium, and the piercing portions being provided on an outer peripheral surface of one of the transport driving roller and the transport driven roller.

15. A medium processing apparatus comprising:

a reception unit that is configured to receive a medium to be processed;

the medium drying device which is configured to perform drying processing on the medium received from the reception unit; and a processing unit that is configured to perform processing on the medium received from the reception unit or the medium drying-processed by the medium drying device, wherein the medium drying device comprises, a drying processing unit configured to dry a medium recorded by a recording section and transported; and a perforation portion configured to form a plurality of holes in the medium that has been recorded on by the recording section.

* * * * *